US006494634B1

(12) United States Patent
Inoue et al.

(10) Patent No.: US 6,494,634 B1
(45) Date of Patent: Dec. 17, 2002

(54) PENPOINT TIP AND AN APPLICATOR HAVING THE TIP INCORPORATED THEREIN

(75) Inventors: Shigeyasu Inoue, Kashiwara; Masahiro Yasunaga, Osaka, both of (JP)

(73) Assignee: Sakura Color Products Corporation, Osaka (JP)

( * ) Notice: Subject to any disclaimer, the term of this patent is extended or adjusted under 35 U.S.C. 154(b) by 0 days.

(21) Appl. No.: 09/533,636

(22) Filed: Mar. 22, 2000

(30) Foreign Application Priority Data

Mar. 26, 1999 (JP) ..... 11-084353

(51) Int. Cl.[7] ..... B43K 7/00
(52) U.S. Cl. ..... 401/216; 401/209; 401/219
(58) Field of Search ..... 401/209–217, 401/219

(56) References Cited

U.S. PATENT DOCUMENTS 3,308,475 A * 3/1967 Bean ..... 401/209 X
3,960,455 A 6/1976 Balassiano ..... 401/209
5,520,473 A * 5/1996 Durham ..... 401/216
5,527,124 A * 6/1996 Kolaric ..... 401/209 X
5,929,135 A * 7/1999 Wasai et al. ..... 401/217 X

FOREIGN PATENT DOCUMENTS

GB 2176152 A * 12/1986 ..... 401/214
JP 8-238884 9/1996

* cited by examiner

*Primary Examiner*—Timothy L. Maust
*Assistant Examiner*—Kathleen J. Prunner
(74) *Attorney, Agent, or Firm*—Wood, Phillips, Katz, Clark & Mortimer

(57) ABSTRACT

A penpoint tip and an applicator having the tip incorporated in it are disclosed, the applicator (1) is composed of a shaft (2), an inking core (3) and a cap (4). The inking core (3) has a penpoint tip (5), an ink reservoir (6), a connector (7) and a valve (8). The penpoint tip (5) constituting an ink applying member has six balls (10) arranged in a row in a distal end of the tip. Each ball (10) is exposed outwards in part out of a slit-shaped opening (16) of a tip body (12).

26 Claims, 24 Drawing Sheets

PENPOINT TIP AND AN APPLICATOR HAVING THE TIP INCORPORATED THEREIN

FILED OF THE INVENTION

The present invention relates to a penpoint tip that is particularly designed for use to draw a thick line with one stroke of a pen, or occasionally parallel thinner lines also with one stroke.

The penpoint tip of the present invention is intended for incorporation into an applicator that may be used to write characters, to draw thick lines, to color some figures or the like and/or to paint out some previously written incorrect characters or the like to be amended.

BACKGROUND OF THE INVENTION

Ball-point pens are now widely used as a convenient ink applicator easy to use. However, the penpoint tips of the ball-point pens literally comprise each a 'ball' serving as a principal part for application of ink to any desired surfaces or articles. Such a ball will usually be brought into an extremely narrow 'point' contact with those surfaces. Therefore, any thick line can neither be drawn with one stroke of the pen, nor any broad areas can be painted using such a ball-point pen.

Some prior proposals are disclosed for example in the Japanese Utility Model Laying-Open Gazette Sho. 58-69479, Patent Laying-Open Gazette Hei. 7-290877 and ibid. Hei. 7-290878. These proposals are directed to certain improved penpoint tips and applicators each employing a single roller in place of the ball and capable of drawing thicker lines.

Those prior art applicators comprise ink reservoirs and penpoint tips secured to the distal ends of the respective reservoirs, wherein each tip has only a single roller held therein. In use, this roller will be pressed to and rotated on a paper sheet or the like so that the roller covered and wetted with ink does continuously transfer it to the sheet, when drawing a thick line thereon.

In order to maintain tight and stable contact of the paper sheet with the ink applying roller in such a known penpoint tip, the applicator has to be kept at a proper angle relative to the sheet. Further, every stroke must be made perpendicular to the axis of said roller, rendering it somewhat inconvenient to use those known applicators. In addition, it has been considerably difficult for those penpoint tips to draw curved lines, even if straight lines could be drawn relatively easily.

Even if requirement for the roller to rotate at an even speed over its full width relative to the paper surface could be met when stroking straight lines, but it would not be met when drawing curved line. In the latter case, an inner and out edge regions of the roller cannot rotate simultaneously at the same angular speed. Such a roller almost incapable of turning smoothly have thus caused the curved lines to become broken and/or blurred.

As a result, the known roller-type penpoint tip have failed heretofore to write 'unsimple' characters or draw figures, even if possible to draw 'simple' straight lines.

Objects of the present invention made in view of such drawbacks inherent in the prior art is therefore to develop and provide a novel penpoint tip as well as a novel applicator having the tip incorporated therein, that are able to draw a thicker line, whether the line is straight or curved, and whether the line is transverse or oblique in any direction.

SUMMARY OF THE INVENTION

In order to achieve one of these objects, the penpoint tip proposed herein does comprise: a tip body, a plurality of balls, the tip body consisting of a ball retainer with an opening and an ink-feeding rigid tube formed integral with the ball retainer and having an ink feed bore in fluid communication therewith, wherein the balls are held in the ball retainer such that a part of each ball is exposed from the opening so as to be capable of applying ink onto an article surface, characterized in that the balls are held in the single and common ball retainer and arranged in a row in such a fashion that each ball has a part exposed outside.

The penpoint tip of the invention employs a plurality of balls incorporated therein instead of the prior art roller so that ink will be applied as the balls rotate.

In the present penpoint tip, each of those balls in a row is exposed in part from a ball retainer. With this tip pressed onto a paper sheet, all the balls in the tip will contact the sheet while rotating independently of each other. They will rotate at different rotational speeds while drawing a curved line. Some balls advancing along a smaller-radius edge of said line will rotate at speeds lower than the others advancing along a larger-radius edge will do. Ink will be applied to the sheet from all the balls and at substantially the same flow rate, thus enabling the tip to draw a thick or heavy line.

In a preferable embodiment or modification of the penpoint tip just described above, the opening formed in the ball retainer is of an elliptic contour or an elongated circular contour. The minor axis or shorter inner diameter of such an elongated opening is designed appropriately smaller than the diameter of each ball, thereby protecting the balls from unintended disengagement from the tip.

In this embodiment, the penpoint tip having the elongated opening whose minor axis is smaller than the balls will surely hold them in place not to slip off.

The elongated opening which the penpoint tip of the invention may preferably have a major axis that is equal to or less than the product of "ball diameter" and "the number of balls" held in the retainer.

The penpoint tip having this feature is advantageous in that the balls are stabilized in position in the direction of major axis. The balls are thus protected from staggering perpendicularly or longitudinally of said major axis, whereby any unevenness or irregularity, in particular uneven width, will not be produced in lines drawn with the tip.

In another embodiment, a seat may preferably be formed in the ball retainer at its region that is located adjacent to the distal end of the ink feed bore. The balls in this case will rest on the seat that extends along the row of said balls.

The seat contacting and supporting the balls in this embodiment will render them stable in position, allowing smooth rotation.

In still another embodiment, the seat may desirably consist of a tapered and inclined flat plane.

The tapered flat seat in such an embodiment is devoid of arrow-shaped grooves (viz., 'ink grooves'), so that the balls held stable on said seat can spin further smoothly.

In a further embodiment, recesses each being a part of a spherical surface are formed in the seat.

Ink application will be done with the balls resting on the seat and engaging with those spherical recesses. The balls in penpoint tip of this embodiment will take more stable positions without any mutual interference and will thus rotate more smoothly, also preventing any unevenness or irregularity, in particular uneven width, from being produced in the lines drawn with this tip.

In still further embodiment, groove-shaped cutouts are provided in the seat at positions thereof corresponding to the center of balls. Each ball does not abut against the bottom of each cutout, but does contact opposed edges thereof.

The balls in penpoint tip of this embodiment will likewise take very stable positions without any mutual interference and will thus rotate very smoothly, also preventing any unevenness or irregularity, in particular uneven width, from being produced in the lines drawn with this tip.

In an alternative embodiment, grooves are formed in the seat so as to communicate with the ink feed bore.

These grooves in this alternative embodiment will be advantageous in that ink supplied through the grooves and passing by the balls will completely wet them.

In a still further embodiment, the opening of the tip body is caulked along the balls.

The penpoint tip having such a caulked opening will more surely hold the balls in place, without hindering them from smoothly rotating.

In a different embodiment, the end opening of the tip body is corrugated.

Also in this embodiment, the balls will be retained in a reliable fashion ensuring smooth rotation thereof.

An applicator, particularly an ink applicator, also provided herein does comprises an ink reservoir and characteristically has fixed on its distal end such a penpoint tips as discussed in any of the preceding embodiments.

The penpoint tip in the applicator may either be attached directly to the reservoir, or more usually a connector may intervene between them.

The penpoint tip consulting the applicator will thus have a plurality of balls rotatable to apply ink to an article surface.

Also in the applicator of this type, the balls held in its penpoint will rotate independently of each other such that rotational speed is allowed to differ between the balls drawing a curved line. In detail, some balls advancing on or along a smaller-radius edge of said line will rotate relative to the paper sheet or the like slower than the others advancing on or along a larger-radius one. Ink will be applied to the sheet in this manner from all the balls, enabling the penpoint tip of the invention to draw a thick or heavy line.

In an embodiment of the applicator, it comprises a cylindrical shaft, and a distal end portion of the penpoint tip is slanted relative to this shaft.

The applicator of this type makes it possible to easily apply an ink to any article surface, keeping a convenient angle between the surface and the shaft.

BRIEF DESCRIPTION OF THE DRAWINGS

The embodiments of the present invention will now be described in detail, referring to the drawings in which:

FIG. 17(*b*) is a cross section of a distal part of the applicator shown in FIG. 17(*a*);

BEST MODES OF CARRYING OUT THE INVENTION

Figure 1:
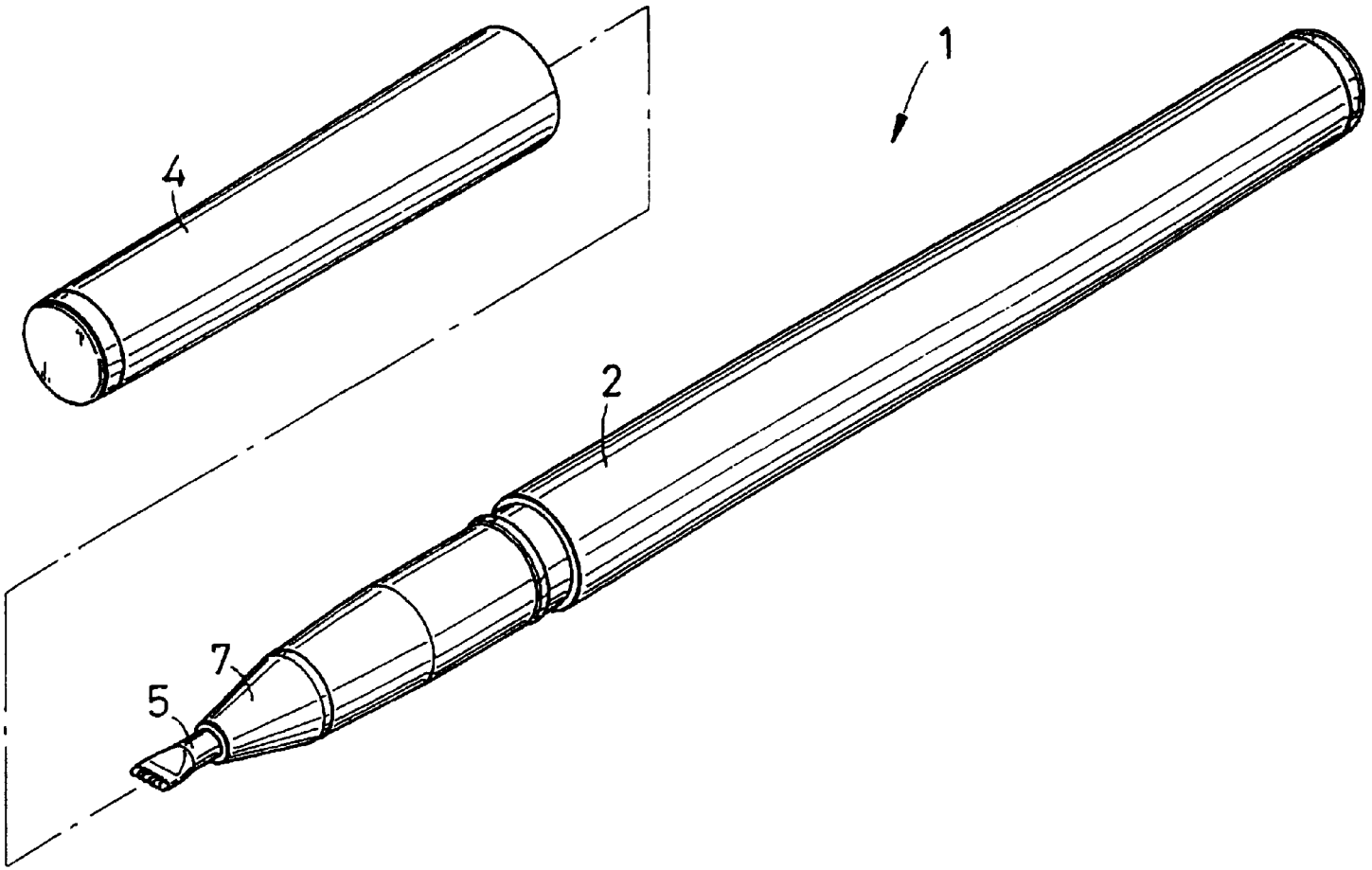
FIG. 1 is a perspective view of an applicator provided in an embodiment of the invention.
Figure 2:
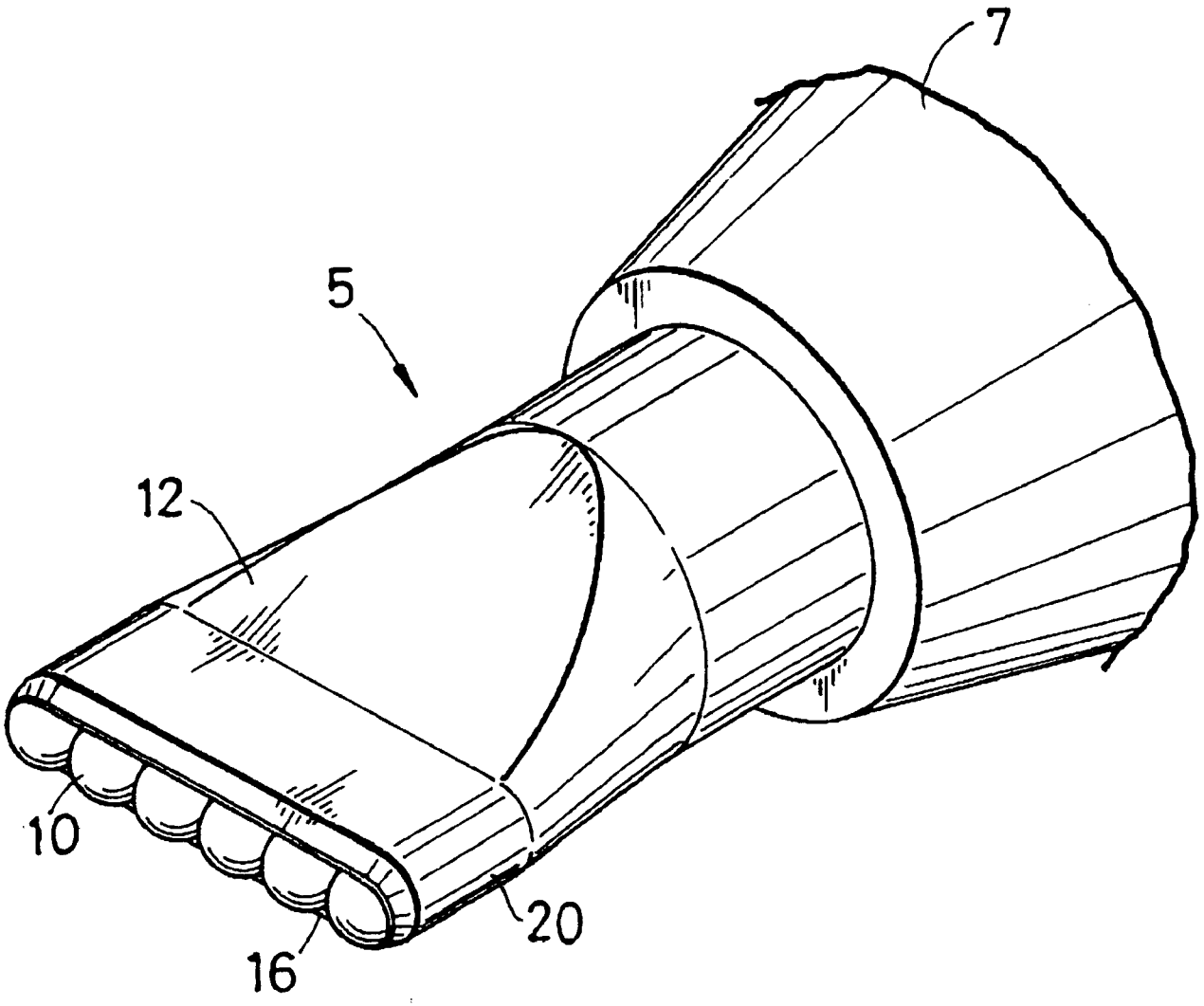
FIG. 2 is an enlarged perspective view of a distal end of the applicator shown in FIG. 1.

In the drawings, the reference numeral 1 denotes an applicator provided in an embodiment of the present invention. Fundamentally, the structure of this applicator is similar to that of the so-called aqueous ball-point pens. From a certain point of view, it may be considered that a specially designed penpoint tip proposed herein does substitute for those which have usually been incorporated in the prior art aqueous ball-point pens. The present applicator 1 basically consists of a cylindrical shaft 2, an inking core 3 and a cap 4. The cylindrical shaft 2 can be grasped by the hand of a user to facilitate manipulation of the applicator. The inking core 3 is composed of a penpoint tip 5, an ink cylinder (or 'reservoir') 6, a connector 7 and a valve body 8.

The penpoint tip 5 is an ink feeding member comprising six (6) ink dispensing balls 10 that are straightly arranged in a row at a distal end of said tip 5. A tip body 12 having an ink feed bore and the six balls 10 constitute the penpoint tip 5.

A metal or plastics may be used to form the tip body 12, which may be manufactured by any appropriate method. If a raw metal material is used, then it may be machined, forged, pressed, cast (e.g., die-cast) or otherwise processed to form said body 12. Alternatively, a polyacetal resin that may be used as the plastics will be injection molded to form the tip body.

Figure 5:
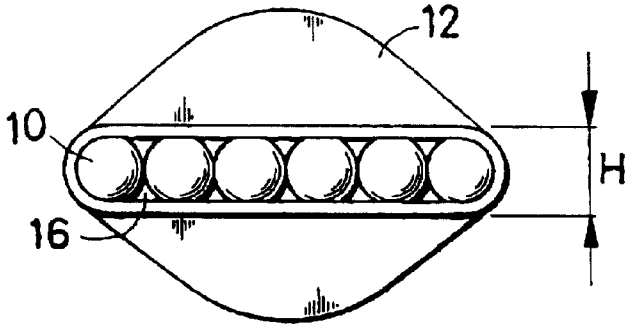
FIG. 5 is a plan view of the penpoint tip shown in FIG. 4.
Figure 6:
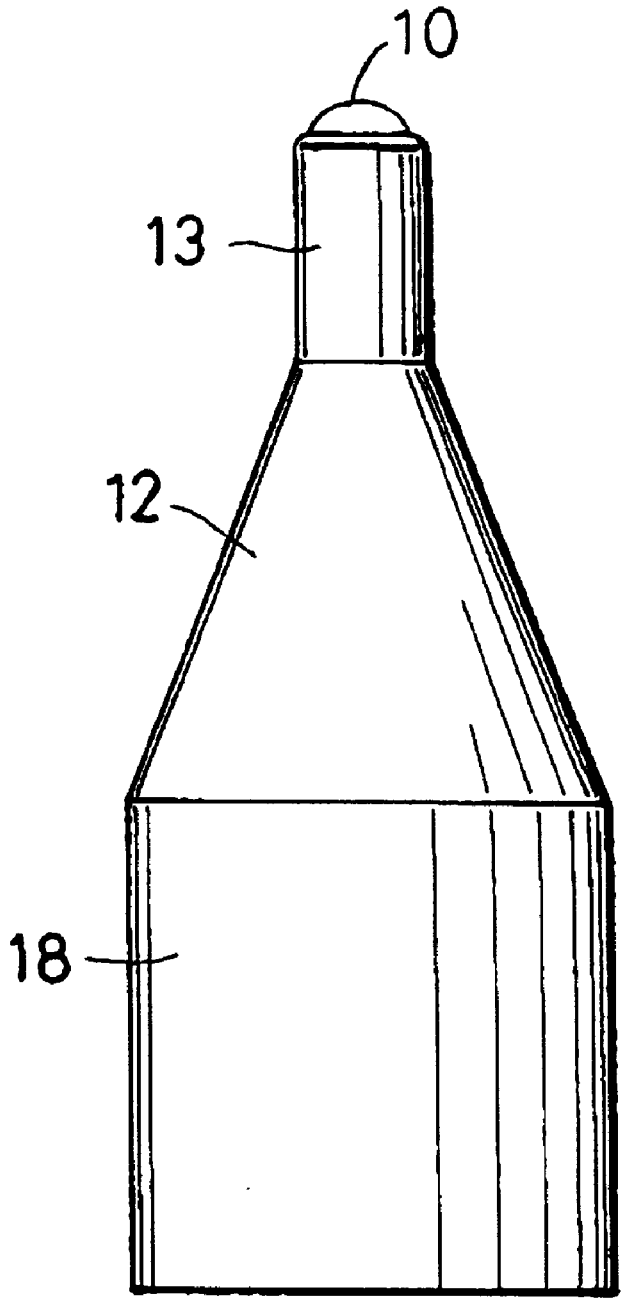
FIG. 6 is a side elevation of the penpoint tip shown in FIG. 4.
Figure 7:
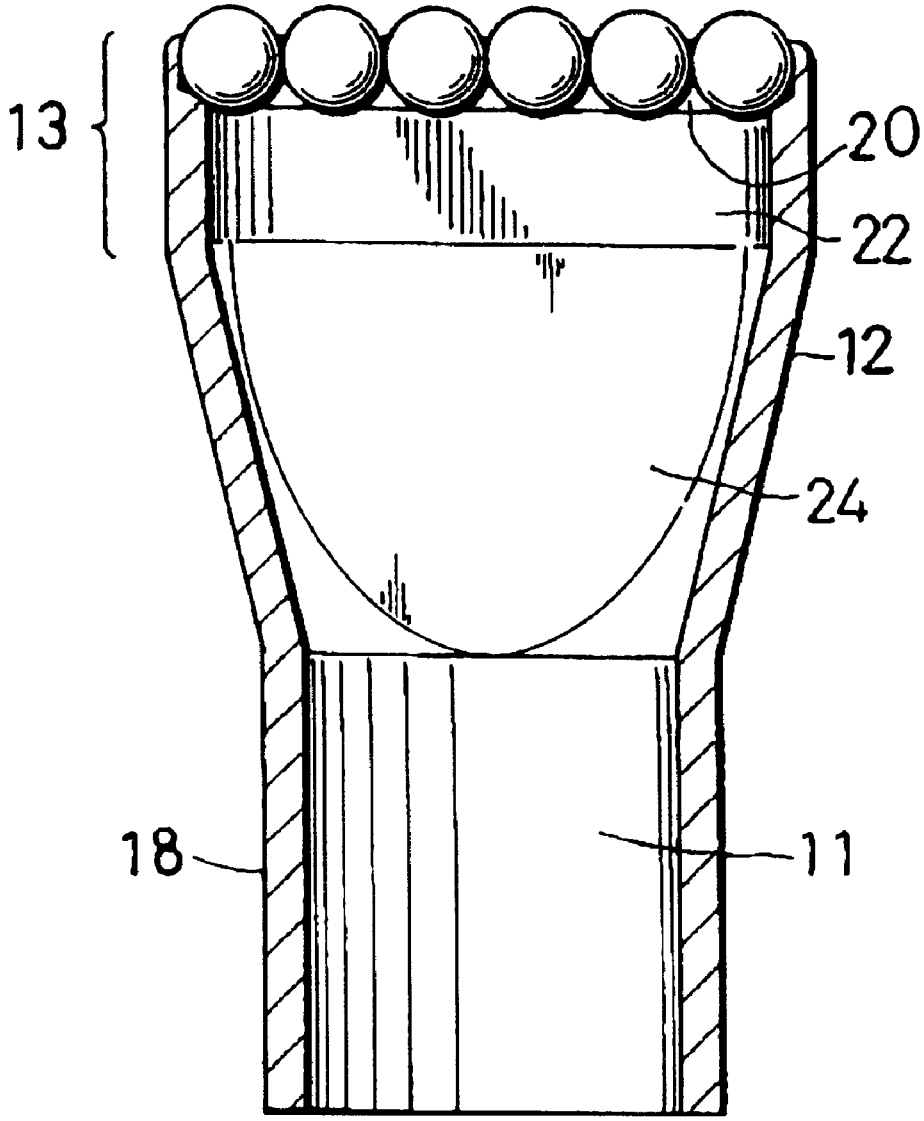
FIG. 7 is a front elevational-cross section of the penpoint tip shown in FIG. 4.
Figure 8:
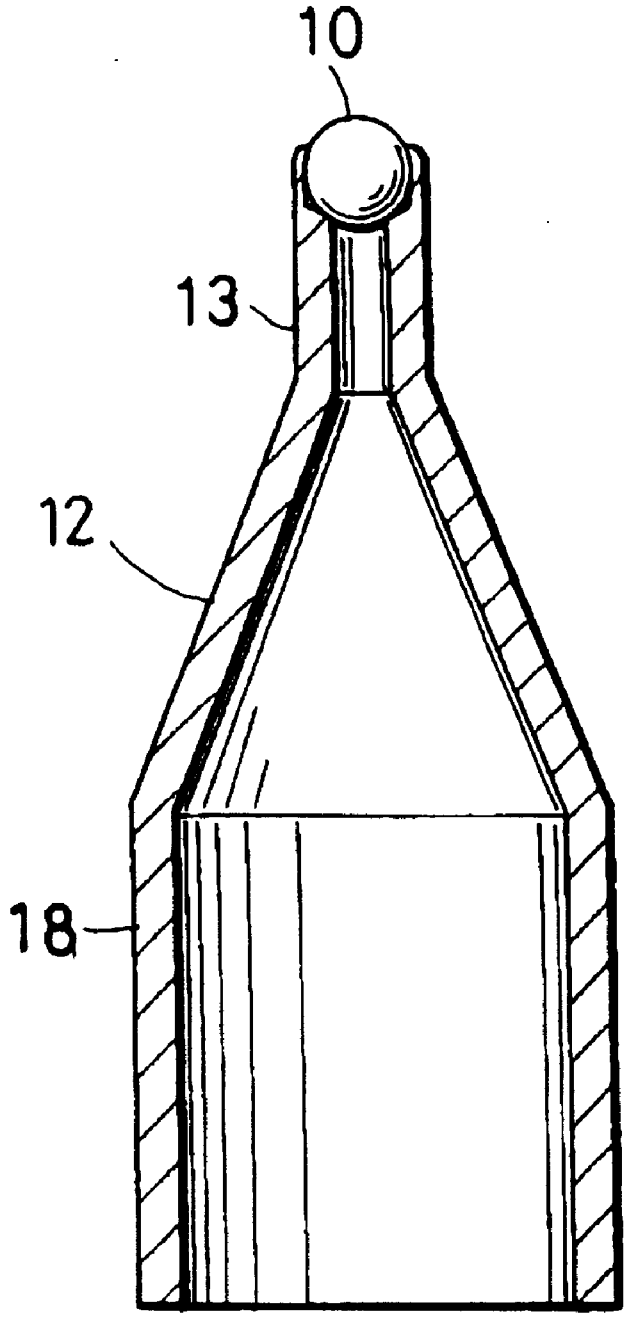
FIG. 8 is a side elevational-cross section of the penpoint tip shown in FIG. 4.

In its appearance, the tip body 12 resembles a length of tube whose one end is depressed. Thus, a distal minor end 13 of this body 12 is of a somewhat flat depressed shape and a proximal major region 18 is of a cylindrical shape. An elongated circular or elliptic opening 16 is formed at and integral with a distal extremity of the penpoint tip 5, as seen in FIG. 5 and more clearly in FIG. 9. This opening 16 is of such a size that each ball 10 is exposed only by about a fourth or third of its diameter. The minor axis of such an elongated opening will thus be about 85–99%, or more preferably about 95–99% of the ball, so as to be slightly less than the diameter of each ball 10.

It is preferable that the major axis of such an elongated circular opening 16 is larger than a first 'product' of (diameter or each ball) and (the number of balls minus 1). If the major axis is equal to or less than this 'product', then the outermost ones of those balls will not function well to apply ink. On the other hand, the elongated circular opening 16 should have the major axis not exceeding a second 'product' of (diameter of each ball 10) and (the number of balls in the retainer). The balls would not slip off insofar as the minor axis of said opening is smaller than the ball diameter, even if the latter were greater than the second 'product'. However, the balls in such a case would be unstable in position due to their undesirable rolling in the direction of the major axis. Thus, the most preferable range of the major axis of the opening 16 is from about 90% to 99% of the second 'product'.

Figure 4:
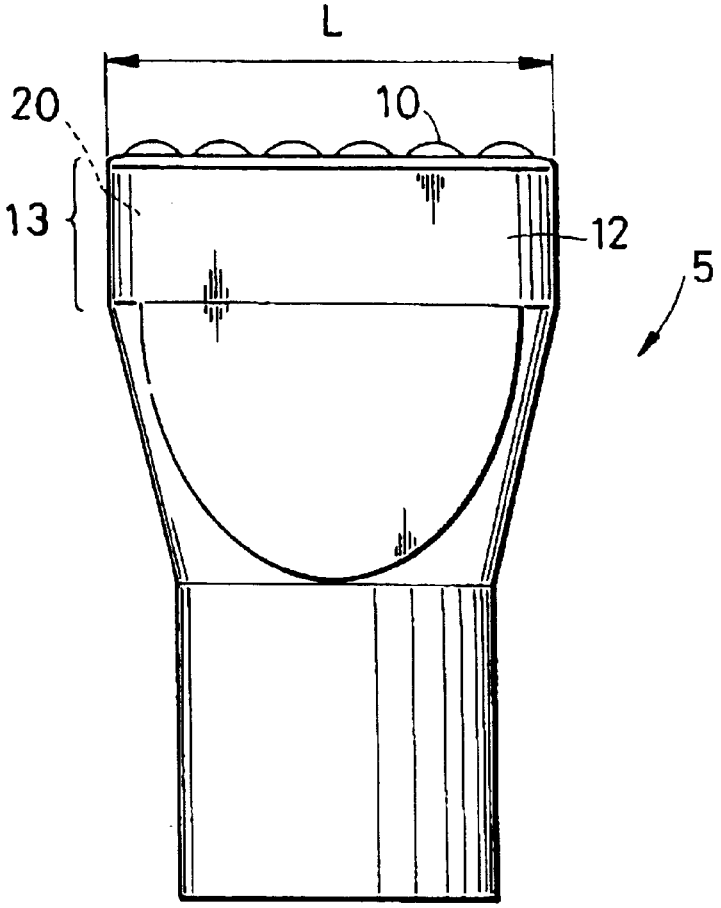
FIG. 4 is a front elevation of a penpoint tip in an embodiment of the invention.

The width or length 'L' (see FIG. 4) of the penpoint tip's 5 distal extremity is greater than diameter of the cylindrical major portion 18. Height or width 'H' (see FIG. 5) of said extremity of the tip 5 is smaller than said major portion 18. Such a configuration of the penpoint tip may not be restricted to that which has been discussed just above, but may be modified in any fashion and to be straight as exemplified in FIG. 21. Alternatively, the cylindrical major portion 18 may be of a diameter equal to or larger than the length "L" of the tip's distal extremity.

Adjacent to the distal extremity of the penpoint tip 5, there is a region where the ratio of width 'L' to width 'H' remains constant in the longitudinal direction of said tip, as will be seen in FIGS. 4 to 8. A tapered region intervenes between this region and the proximal major region 18.

Figure 9:
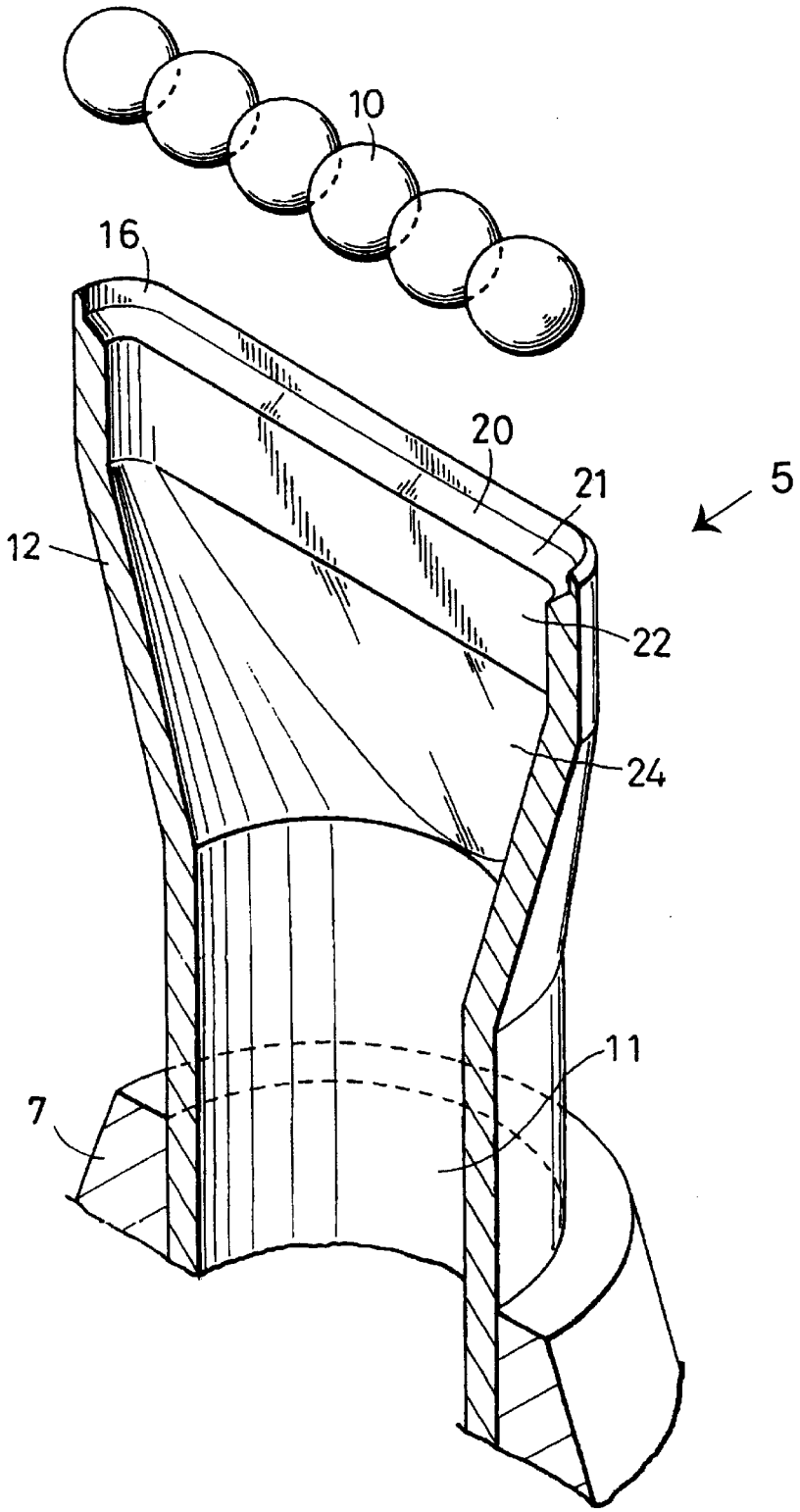
FIG. 9 is a cross-sectional perspective view of the penpoint tip shown in FIG. 4.

The penpoint tip 5 having an interior as illustrated in FIG. 9 has one single ball retainer 20 in the distal extremity thereof. This retainer is a cavity dimensioned to accommodate a transverse row of the six balls 10. A bottom of this cavity is formed as a tapered seat 21 for the balls, and this seat converges to an ink guiding or distributing chamber 22 generally of a rectangular cross section.

The ink distributing chamber 22 continuing from the inner end of the ball retainer 20 does in turn continue to a cylindrical proximal region 11, via a transition region 24. The distributing chamber 22, cylindrical portion 11 and transition region 24 constitute as a whole the ink-feeding rigid tube, and that portion 11 is open at a proximal end of the tip body 12.

The seat 21 extends in parallel with the opening 16. In other words, the seat 21 extends in a direction of the balls 10 arranged in a row.

In this embodiment, the seat 21 is slanted as noted above and no grooves, arrow-shaped or otherwise shaped ink grooves, are formed in that seat. In other words, the ball seat 21 is simply an oblique flat plane.

The so-called arrow-shaped grooves present in the prior art conventional ball-point pens are absent in the ball retainer's seat of the present penpoint tip 5.

The reason why this penpoint tip 5 has such a structure is that the balls 10 will never clog or stop the elongated chamber 22 for distribution of ink, in contrast with the fact that the single ball in each of usual ball-point pens does always tend to stop their circular ink guiding chamber. Further, a clearance is present in every two adjacent balls 10 in each tip of the invention, so that ink will spread around the entire spherical surface of each ball without aid of any prior art ink grooves.

Such ink grooves, if improperly located, would sometimes render unstable in position the balls 10 on the seat, with some fear of making unsmooth their rotation or unevenly exposing them.

It may however be possible to employ such grooves also in this invention, depending on various conditions and in particular in the event that the ink would be of a considerably high viscosity.

Figure 23:
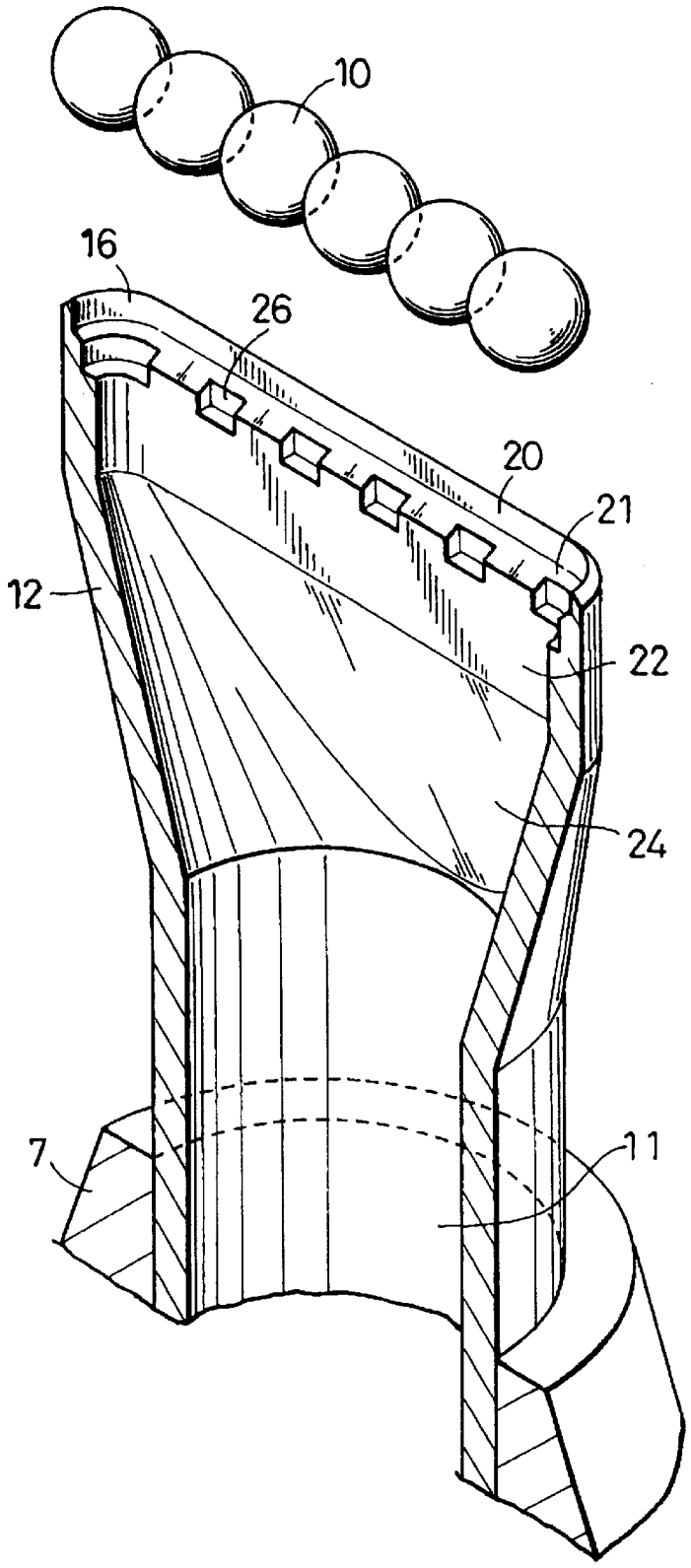
FIG. 23 is a fragmentary perspective view of the penpoint tip provided in a further embodiment and shown partly in cross section.

Discrete, groove-shaped cutouts/recesses 26 may be formed in the seat and located corresponding to the centers of respective balls, as shown in FIG. 23. The balls fitted in and engaging with such cutouts will be less rickety, thus affording a much smoother hand-writing.

Figure 24:
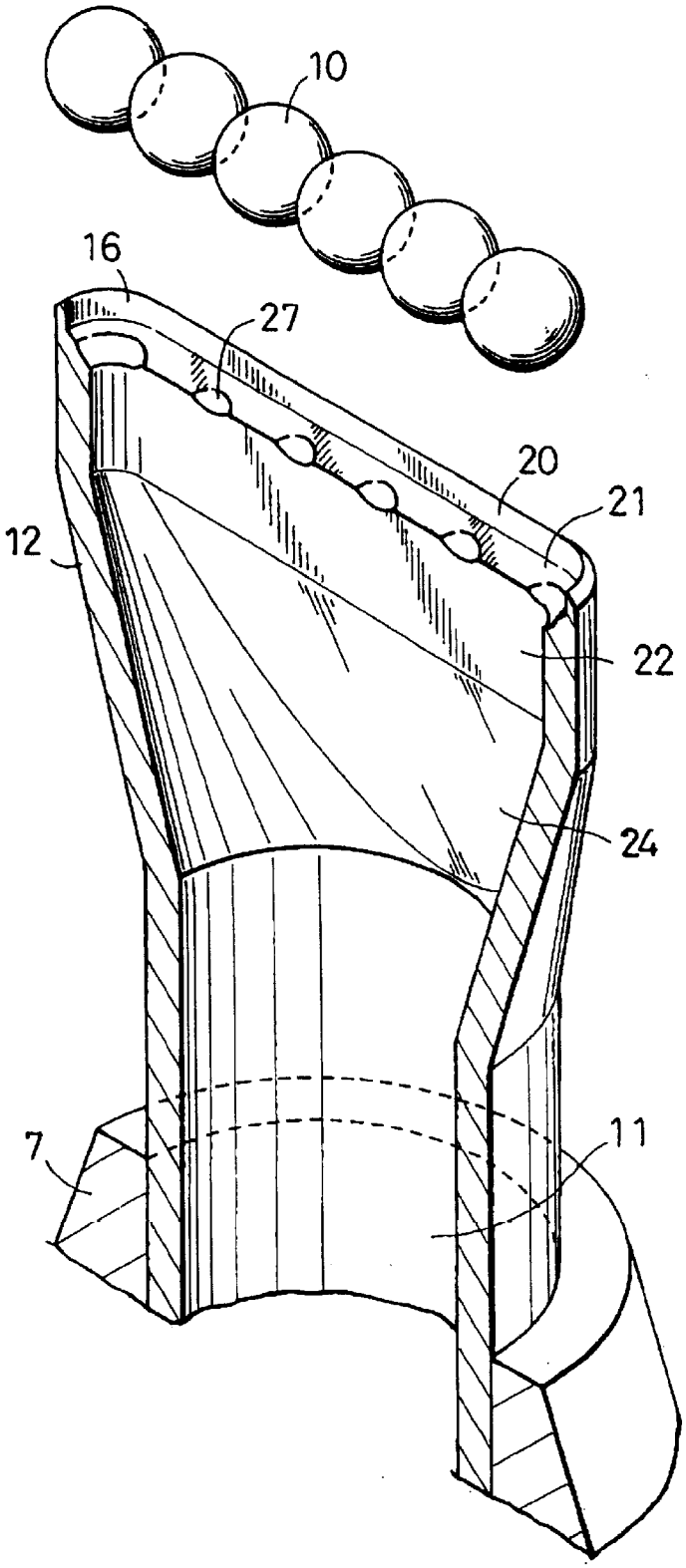
FIG. 24 is also fragmentary perspective view of another penpoint tip provided in a still further embodiment and shown partly in cross section.

Alternatively, spherical recesses 27 may be provided in the seat to receive respective balls in a manner shown in FIG. 24. The balls in the penpoint tip of this embodiment will take more stable positions without any mutual interference and will thus rotate more smoothly, thereby preventing any unevenness or irregularity, in particular uneven width, from being produced in the lines drawn with this tip. Those spherical recesses may be formed using the balls themselves struck on the seat, or using a tool having a tip end of a shape resembling the ball. In contrast with the groove-shaped cutouts each in a 'pointed' contact with a portion of each ball, the spherical recesses are advantageously kept in an 'area' contact with a much larger surface area of each ball.

If a spherical zone is formed in each cutout by striking it with use of the described member, then an enlarged contact area will render each ball much more stable, as compared with the simple cutouts.

Figure 10:
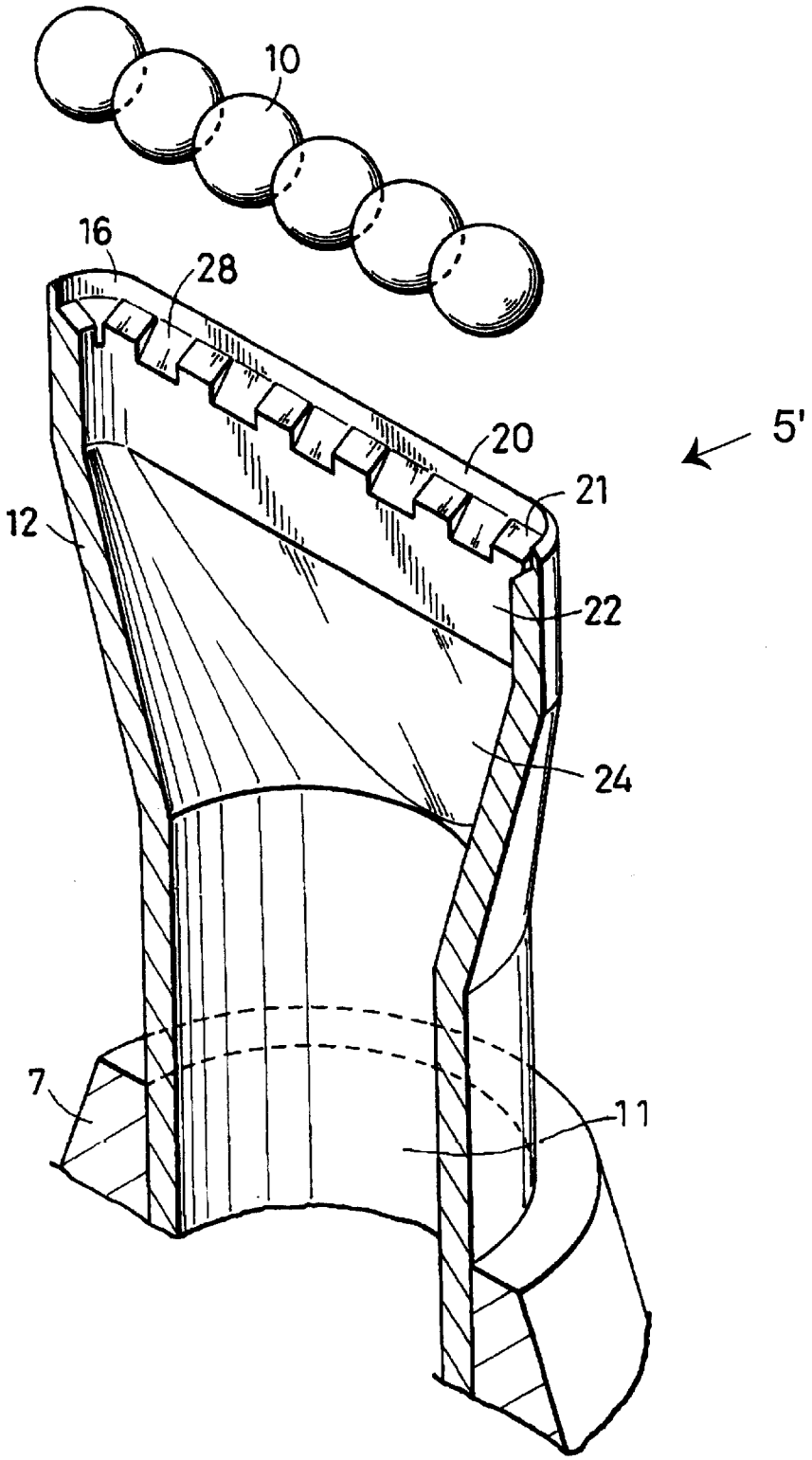
FIG. 10 is a cross-sectional perspective view of the penpoint tip in another embodiment.

FIG. 10 shows an alternative embodiment wherein portions similar to the prior art arrow-shaped grooves are formed in the ball seat 21. This penpoint tip 5' has a ball retainer 20 with a tapered seat 21 in which a plurality of shallow grooves 28 are graven to communicate with the ink guiding chamber 22. Those grooves will function as ink passages and assist ink to completely cover and wet the spherical surface of each ball. The alternative tip 5' is the same as that 5 shown in FIG. 9, except for such grooves 28.

The six balls 10 disposed in the ball retainer 20 which the preceding embodiments comprise may be made from a stainless steel, an 'ultra-hard' alloy (such as a cemented carbide), a ceramics or a glass. The diameter of each ball may usually be from about 0.3 mm to 1.2 mm, or more desirably from about 0.4 mm to 1.0 mm. Preferably, each ball 10 fixed in the applicator 1 of the preceding embodiments is made of the same material to be of the same size as those in the prior art ordinary ball-point pens. However, the material is not delimited in this invention, but may be any metal such as stainless steels and the cemented carbide, or any plastics, rubbers or the like.

All the balls 10 are each exposed outwards and partially out of the slit-shaped distal opening 16 of the tip body 12, and this opening is caulked slightly in a direction of its minor axis so as to be of a width reduced to about 85% to 99% of the diameter of each ball. To ensure satisfactory function of the balls, an extent to which they are exposed out of the throttled opening may generally by designed to be a fourth or third of their diameter. Thanks to this feature, those balls 10 held in the opening 16 can freely rotate therein, without any fear of slipping off the tip body 12.

Those balls 10 retained by the retainer 20 are in contact with the tapered seat 21 within said retainer, during use of the tip or while it lies still with its distal end raised above a horizontal plane.

A polypropylene or the like thermoplastic resin may be used to injection mold the connector 7. The outer configuration of this connector is generally similar to that of the known ball-point pens. The connector 7 has a distal region 30 of a conical shape, and a proximal region that is a stepped cylinder composed of a larger-diameter portion 31 and a smaller-diameter one 32 continuing therefrom.

An ink-flowing or communicating axial bore 33 penetrates this connector 7, longitudinally thereof.

A valve seat 35 is formed as a region of said bore and located intermediately between opposite ends thereof.

The valve body 8 is a ball made of a scarcely rusting material such as a stainless steel, a cemented carbide or a ceramics that are of a considerably high specific gravity.

The ink reservoir 6 is a tubular article made by extruding or otherwise processing a polyethylene, a polypropylene or the like. This reservoir may be filled with any of the known inks of any desired properties. For example, the ink may be a gelled aqueous ink having a viscosity of about 100 to 2000 mPa.S.

This value of viscosity is measured using an ELD type viscometer (R14) with a cone rotating at a speed of 0.5 rpm (at 20° C.).

Aqueous inks including the gelled one will be discussed here in some detail and for reference. Each aqueous ink contains water as a solvent, in contrast with the conventional unctuous or oily inks whose solvent is generally phenyl cellosolve, benzyl alcohol or the like organic solvent.

Viscosity of the oily inks is as high as about 10000–30000 mPa.S, though the aqueous gelled inks are less viscous and may be grouped into two types in view of their behavior.

The inks of one of these types are Newtonian fluids (with a constant viscosity not depending upon flow velocity). Therefore, such inks will not change in their viscosity whether they are in the reservoir 6 or in the ball retainer 20. A proper viscosity may be from 5 to 2000 mPa.S, and more preferably from 5 to 200 mPa.S.

The inks of the other type are of such a property that their viscosity will vary due to flow condition. For example, they will show a higher viscosity of about 2000–8000 mPa.S within the reservoir and a much lower viscosity of 10 mPa.S or less within the ball retainer 20. Therefore, they are sometimes called 'thixotropic inks', and an aqueous ink to which an amount of thixotropic gelling agent is added is usually called 'aqueous gelled ink'.

It is preferable that a trailing rear end of a column of such an aqueous ink is covered with a gelled sealant made of a polybutene or the like.

Any other sealant may be substituted for such a gelled one. The cylindrical ink reservoir mentioned above may be replaced with a container having a closed bottom.

Figure 3:
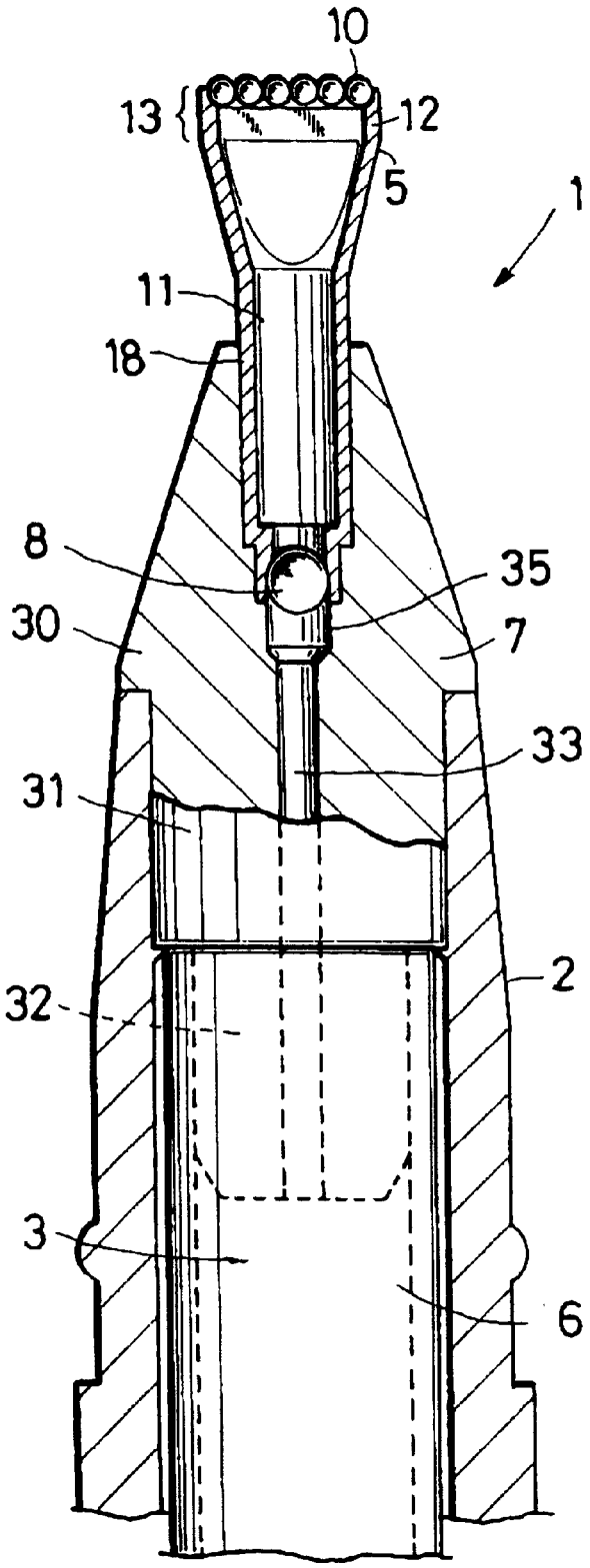
FIG. 3 is a cross section of the applicator shown in FIG. 1.

The inking core 3 comprises the penpoint tip 5 connected by the connector 7 to the ink reservoir 6, as best seen in FIG. 3. The communicating axial bore 33 extending through the connector 7 has a distal end fitting on the penpoint tip 5, and the connector has a proximal end of a reduced diameter fitting in the reservoir 6.

The valve body 8 disposed between the valve seat 35 and a stepped proximal end of the penpoint tip 5 is movable within the connector 7 and axially thereof.

In manufacture, the cylindrical shaft 2 in the ink applicator of the preceding embodiments will receive and fit on the inking core 3 (viz., penpoint tip 5 plus the reservoir 6 plus the connector 7). The larger-diameter region 31 of the connector 7 will thus be kept tight in the inner periphery of said shaft 2, making same integral with said core 3. As usual, the cap 4 will be put on the distal end of the thus assembled applicator 1.

The ball retainer 20 of the applicator 1 is always filled with ink to keep the balls 10 wetted therewith. The valve body 8 placed in the applicator 1 will bear against the valve seat 35 when the applicator is reversed upside down. The ink will thus be prevented from flowing out of the retainer and back into the reservoir 6, even if the applicator stands still and upright with its tip 5 positioned on the top of said applicator.

In use, the applicator 1 of the above embodiments will operate as follows.

When a straight line has to be drawn with the applicator 1 from which the cap 4 has been removed, the penpoint tip 5 should be put down at first forcing its balls 10 towards a paper sheet or the like. Then, the applicator in this state will be moved on and along the sheet, as in case of using the conventional applicators.

Figure 11:
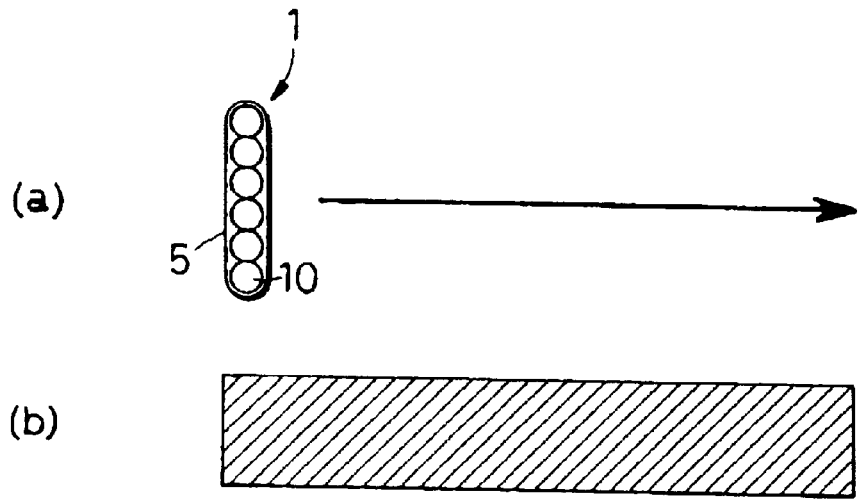
FIGS. 11(*a*) and 11(*b*), 12(*a*) and 12(*b*), 13(*a*) and 13(*b*), and 14(*a*) and 14(*b*) respectively show in combination of the suffixes (*a*) with (*b*) some modes of using the applicator of the invention, wherein each suffix (*a*) denotes a manner of using the applicator and (*b*) denotes a drawn line or lines.

FIG. 11(*a*) illustrates the applicator 1 standing upright and moving in a direction perpendicular to its longer width (viz., its major axis). This motion will produce a line on the paper sheet with a continuous flow of the ink transferred thereto from the tip's balls 10 all spinning in unison with each other. A plurality of these balls arranged in a straight row within the tip 5 will thus dispense ink at substantially the same flow rate. Consequently, the same number of ink streams corresponding to the balls will appear momentarily on the sheet, but will subsequently and instantly converge to form a thicker or bolder line shown in FIG. 11(*b*).

Figure 12:
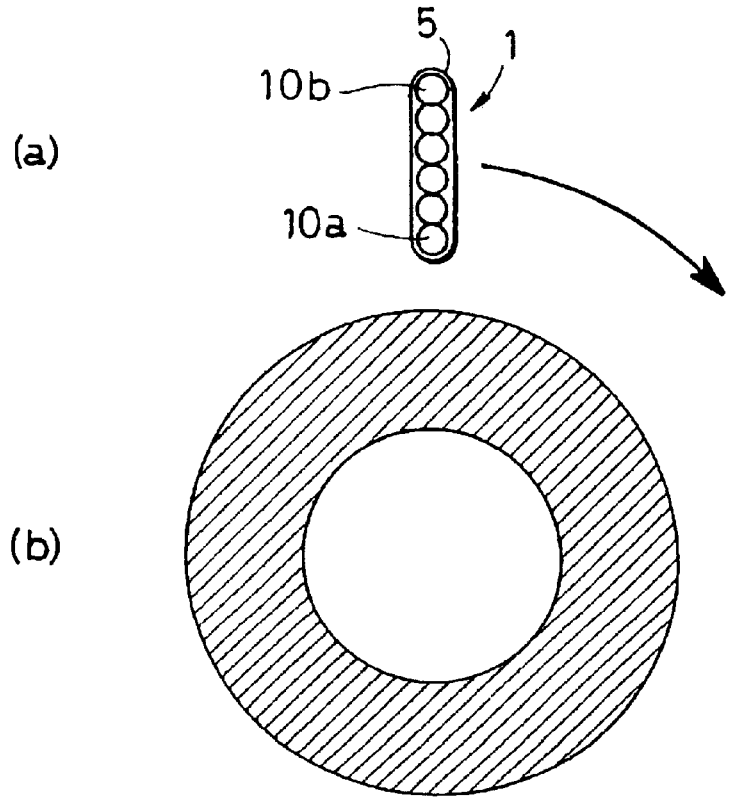

FIGS. 12(*a*) and (*b*) show a manner of writing a curved line, wherein the applicator will be driven to draw an arcuate, for instance circular locus.

The balls 10*a* located inside the circular locus will spin at speeds lower than that at which the other balls 10*b* located outside said locus will do, with all the balls dispensing ink. As a result, a thick circle will be written on the sheet, with the entirety of said balls.

Figure 13:
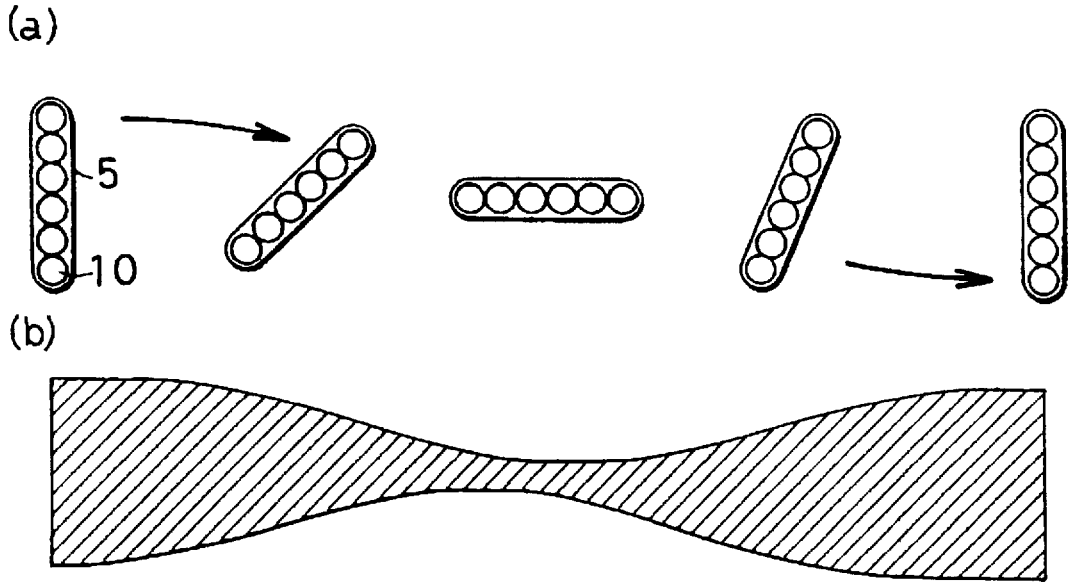

The applicator 1 of the embodiments may also be used to draw a calligraphic pattern in which the thickness of a line varies continuously in the course of the applicator's linear movement. If the applicator 1 is caused to spin while advancing in a linear direction as shown in FIG. 13(*a*), then the effective distance perpendicular to that direction and measured between the outermost balls 10 in the tip 5 will gradually change. Thus, a line drawn in this manner will have a successively changing width as shown in FIG. 13(*b*).

Figure 14:
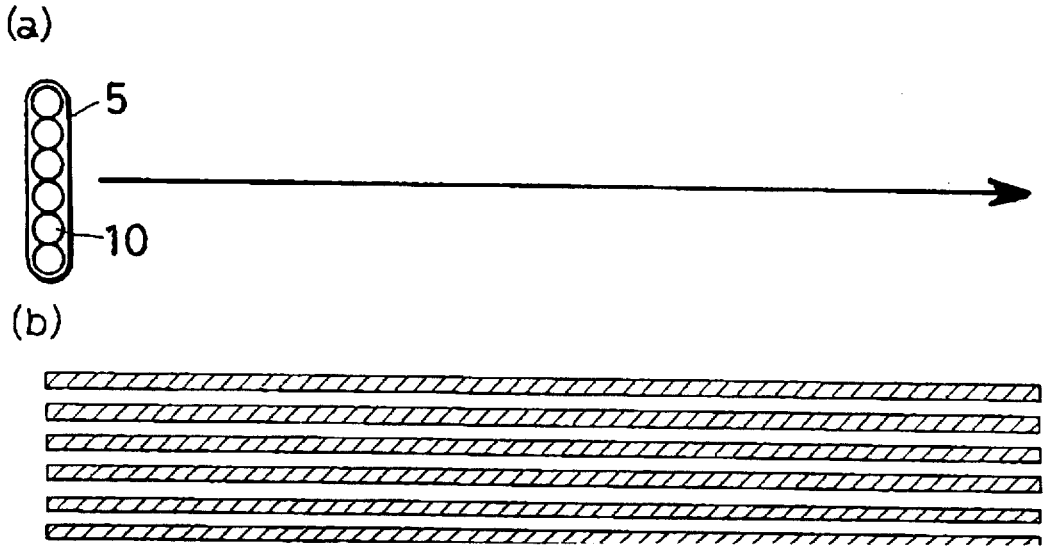

In a special use of this applicator 1, parallel thinner lines as illustrated in FIG. 14 may be drawn with one stroke of the applicator.

In this case, the applicator will be driven to advance in a direction perpendicular to its longer width as shown in FIG. 14(*a*) and at a weaker pressure against a paper sheet or the like. Each of the balls 10 rotating within the tip 5 will remain substantially in a 'pointed' contact with said sheet due to such weaker pressure. Thus, ink stream applied thereto from the balls will never converge with each other. Stripes as exemplified in FIG. 14(*b*) are produced in this manner. It is to be noted here in this connection that the larger the balls 10 in the applicator 1, the more likely to be discrete relative to each other the drawn lines would be. A reduced clearance between each ball 10 and the opening 16 of the tip 5 will give the same effect as the larger balls do.

The number of miniaturized balls in a row is not necessarily 'six' as in the tip in the described embodiments. More or fewer balls may be employed, and it is a matter of course that a lengthened row of more balls will produce a thicker line on paper sheet.

Although a liquid ink fills the reservoir 6 in the embodiments, a fibrous stick or a sponge piece soaked with the ink may be incorporated in the applicator, in place of said reservoir.

It may be possible to employ an intermediate inking core and make use of capillary action to guide ink towards the balls, instead of directly guiding the ink through the valve to the penpoint as in the embodiments.

It also is possible to use such a race-like member as in the usual ball bearings. The balls 10 will in this case be inhibited from colliding one with another within the retainer 20. Corrugation of the retainer's inner walls will also be effective to hold the balls out of mutual contact or collision, thus giving an effect similar to that of the race.

Such corrugated walls of the retainer 20 may be provided for example by the caulking technique. In the foregoing embodiments, only a circumferential edge of the opening 16 is pressed inwards weakly but enough to hold the balls in place. However, in a penpoint tip 40 shown in FIGS. 15 and 16, its ball retainer 20 is strongly pressed and deformed in a centripetal manner to draw the outer edge of the opening 43 caulkingly towards the balls and partially around each ball to such an extent that the thus formed corrugation will prevent the balls 10 from free displacement in a direction along their row, and thereby confine movement of the balls.

Those parts and members which are denoted by the same reference numerals in FIG. 15 and subsequent figures as those in the preceding embodiments will not described below.

Figure 15:
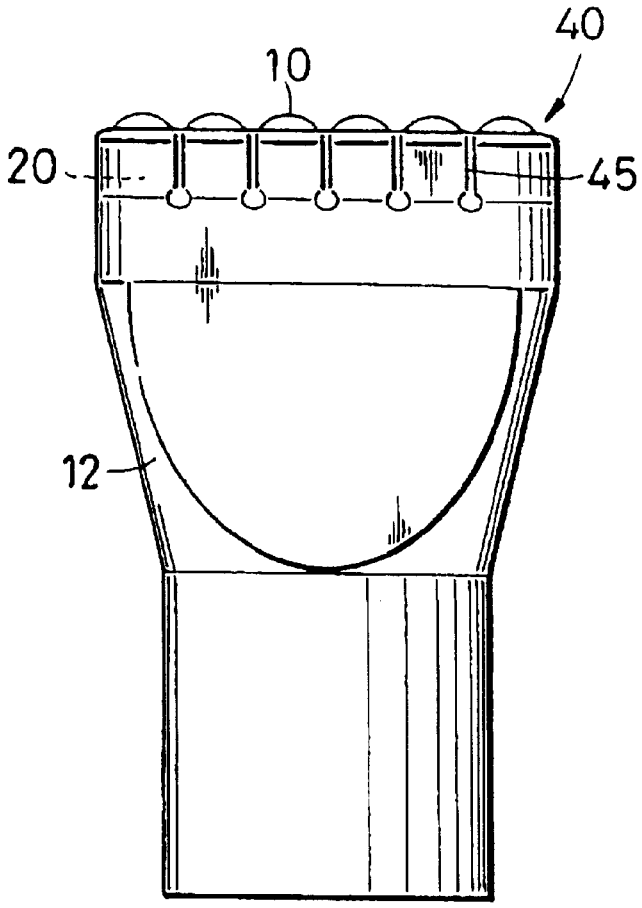
FIG. 15 is a front elevation of the penpoint tip in another embodiment.
Figure 16:
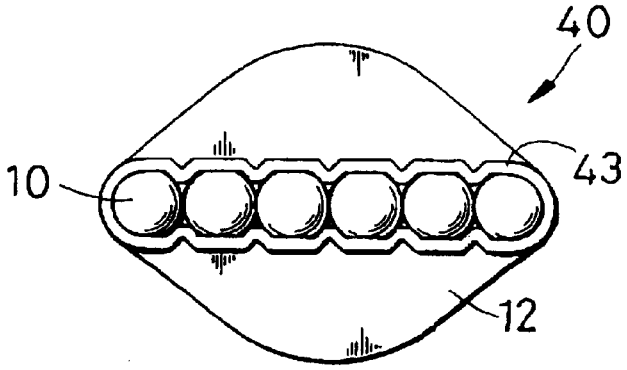
FIG. 16 is a plan view of the penpoint tip shown in FIG. 15.

In the penpoint tip 40 shown in FIGS. 15 and 16, a peripheral wall of the ball retainer 20 as well as an opening edge 43 are forcibly caulked and somewhat deformed. Therefore, parallel and straight streaks 45 will be seen in FIG. 15 that is a front elevation of such a modified retainer. Constricted regions formed stepwise in the retainer in this way will make the balls 10 unable to move in a direction along their row.

The peripheral wall around the opening 43 is thus deformed and corrugated as a result of caulking, as seen in FIG. 16.

Figure 17:
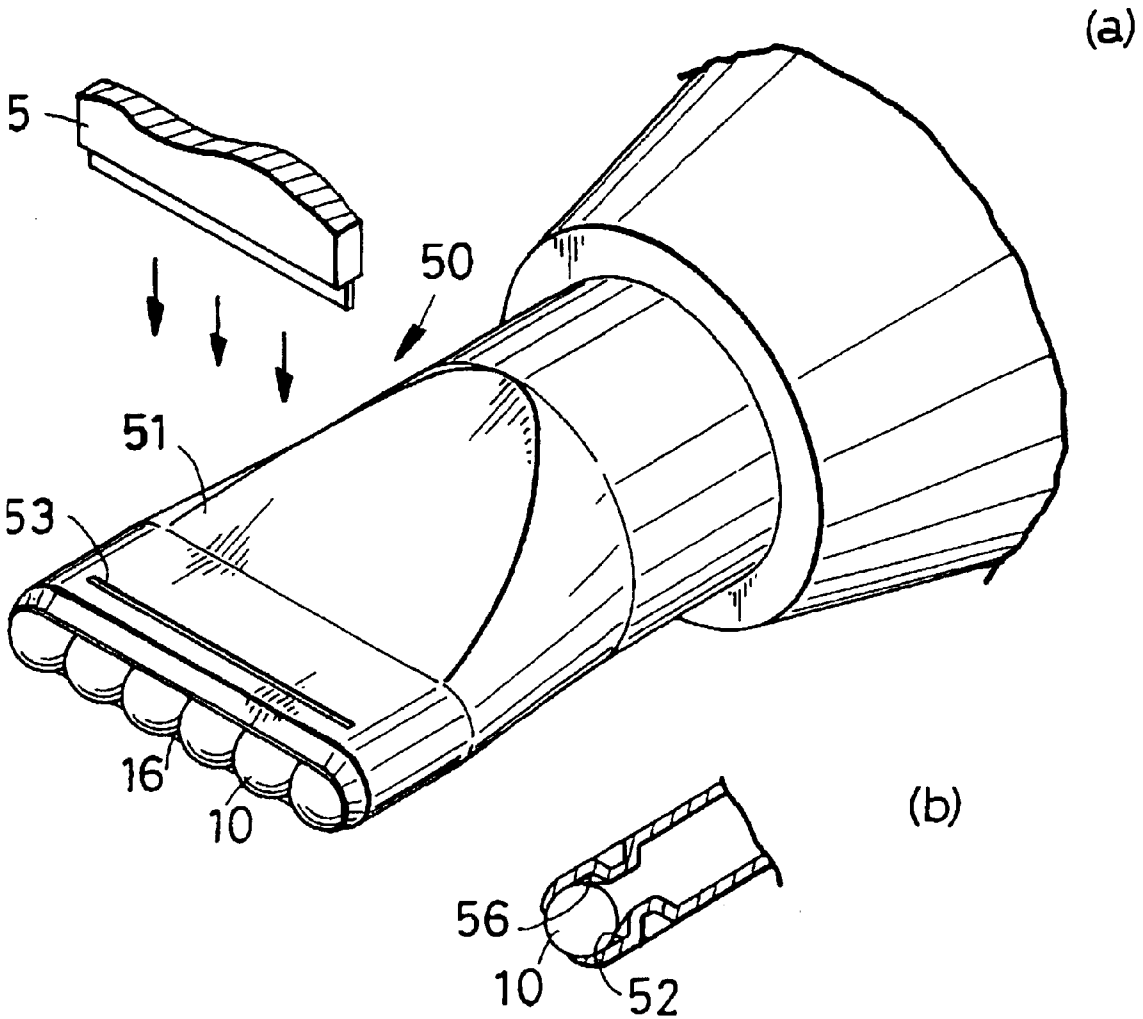
FIG. 17(*a*) is an enlarged perspective view of the applicator in still another embodiment.

FIGS. 17(*a*) and 17(*b*) illustrate a modified ball seat different in shape from that described above.

A modified penpoint tip 50 is shown in FIG. 17(*a*). This tip has its body 51 to which an external inward force has been applied to form the seat 52 in said body, after pressing or forging a raw tubular piece so as to depress its end portion. The inward force has produced a straight 'valley' 53 adjacent to and in parallel with an opening.

A thin and hard tool 55 of a plate-like shape as shown in FIG. 17(*a*) may be used to apply the external force to, and cause plastic deformation in, the tip body 51. The valley 53 may however be produced in any other appropriate method.

FIG. 17(*b*) is a cross section of the penpoint tip manufactured in this manner. This tip 50 has a straight ridge {when seen from inside to outside} that serves as a seat 52 also extending parallel to the row of balls 10 and supporting the same.

Shallow grooves may be formed in the seat 52 of the penpoint tip 50, axially thereof, to communicate with the ink guiding chamber 22, though mechanical processing would not be easy.

Figure 18:
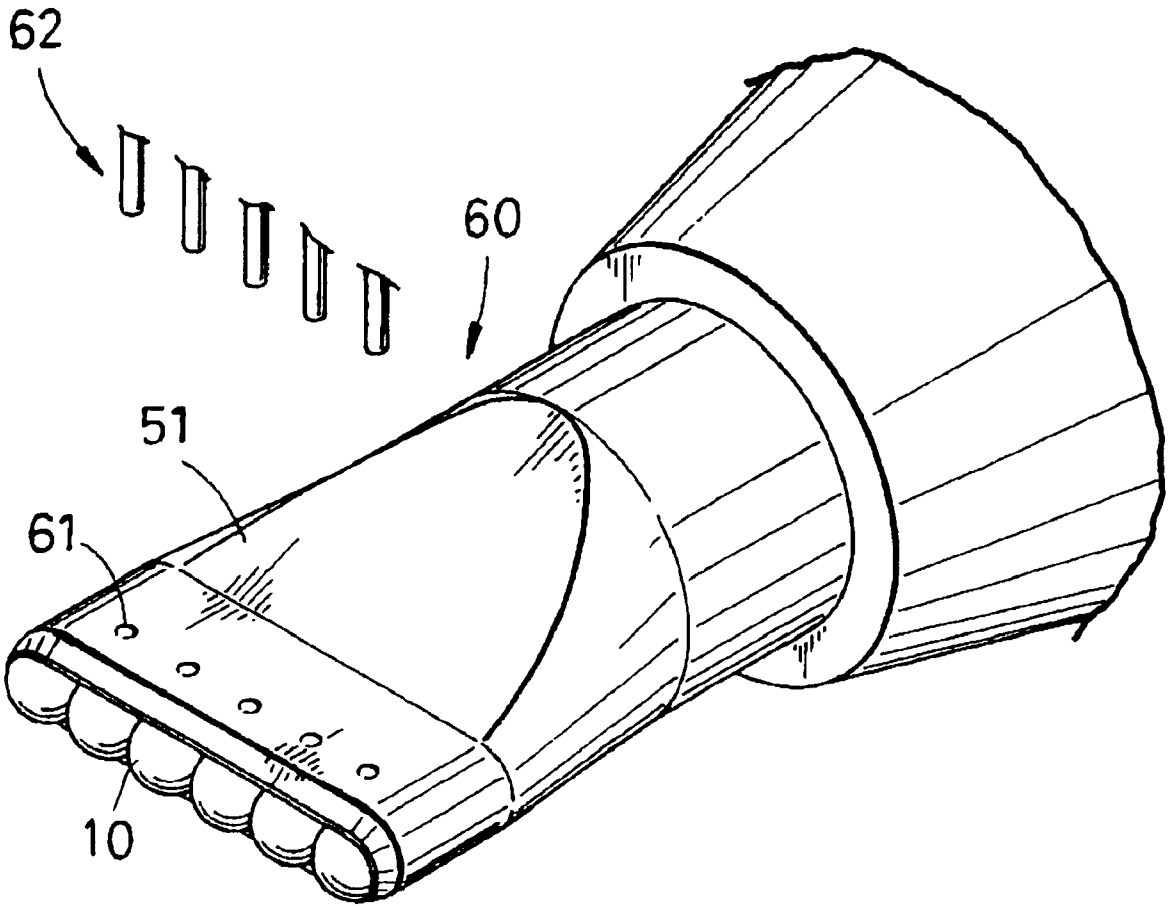
FIG. 18 is an enlarged perspective view of the distal end of an applicator that is provided in a further embodiment.

A further modified penpoint tip 60 of FIG. 18 has a ball seat different in structure from those in the foregoing embodiments. An external force also applied to a tip body 51 in this case has produced discrete dimples 61 that are arranged at regular intervals to cooperate one with another to function as the seat. Those dimples may be deemed lugs (when seen from inside to outside) between which each ball is retained not to move sideways (viz., towards each other).

For example, a tool 62 having a row of hard pins as shown in FIG. 18 may be used to apply the external force to, and cause plastic deformation in, the tip body 51. The dimples 61 may however be produced in any other appropriate method.

Figure 19:
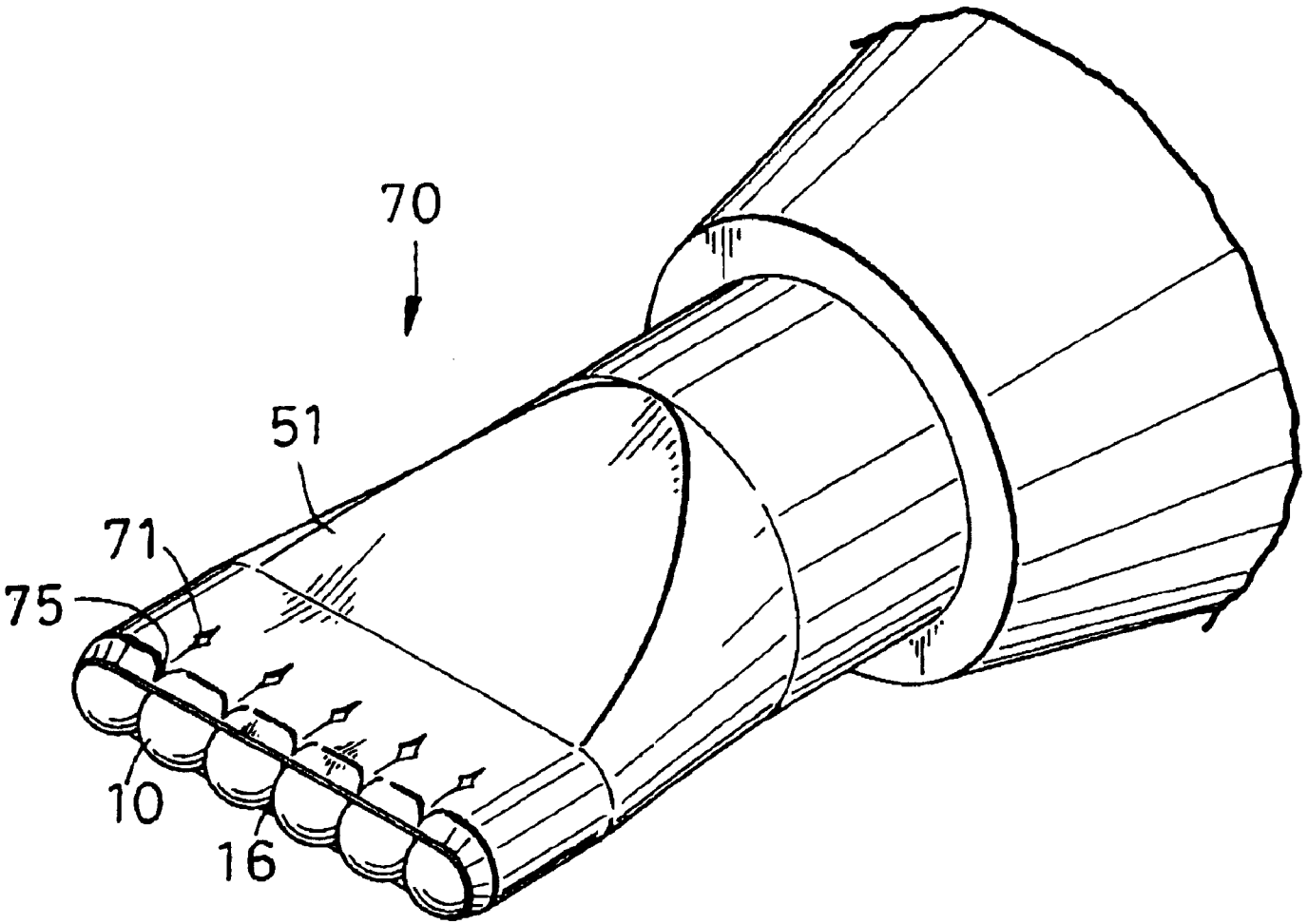
FIG. 19 is an enlarged perspective view of the distal end of an applicator that is provided in a still further embodiment.

Dimples 71 each generally of a diamond shape are formed in a still modified penpoint tip 70 in FIG. 19. Those diamond dimples, which an external force applied to the body 51 has produced similarly to the above embodiments, provide a seat more strictly holding the balls 10 not to move sideways.

Each dimple 71 of a shape similar to an interstice present between the balls 10 will contact same at its increased surface area. Also in the vicinity of the opening 16, axial 'valleys' 75 are formed to prevent the balls 10 from moving sideways.

Figure 20:
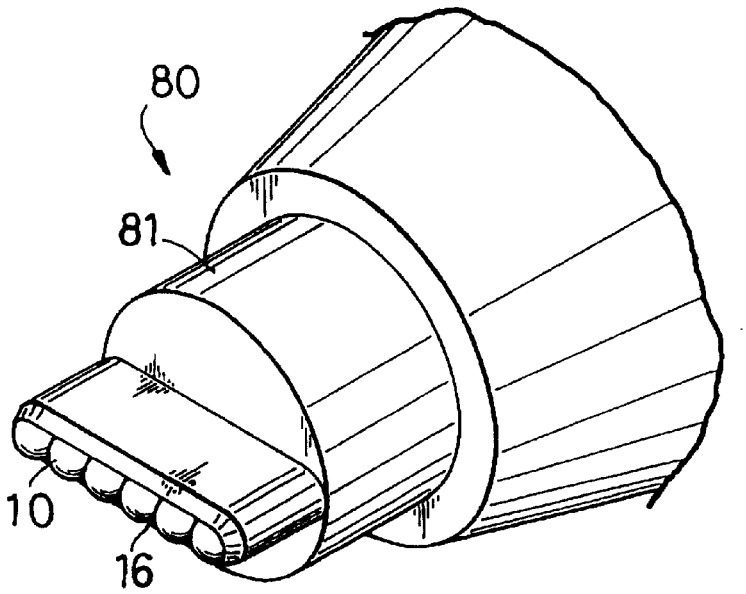
FIG. 20 is an enlarged perspective view of the distal end of an applicator that is provided in a different embodiment.

A penpoint tip 80 of FIG. 20 has its cylindrical body 81 that is suited to being manufactured, for example, by injection molding plastics. In contrast with the preceding embodiments, this body is devoid of a tapered portion and has a ball retainer in direct junction with said body. Inside this tip 80, lugs or the like (not shown) may be formed for inhibiting the balls 10 from wandering sideways.

Either of the following two manners may be adopted to place the balls 10 in such an injection-molded penpoint tip 80.

In one option, an opening 16 of its molded body 81 will originally be formed to have a width (viz., minor axis) substantially equal to each ball's diameter. The balls 10 will subsequently be put in said body 81 of the tip 80, prior to heating and softening the opening to be drawn centripetally.

In another option, a raw unfinished opening 16 will be prepared to be smaller than the ball diameter, and subsequently the balls 10 are forced into the opening while elastically deforming same. Undercut regions unavoidable in such openings will necessitate deformation of molded fresh pieces when ejecting the same.

Figure 21:
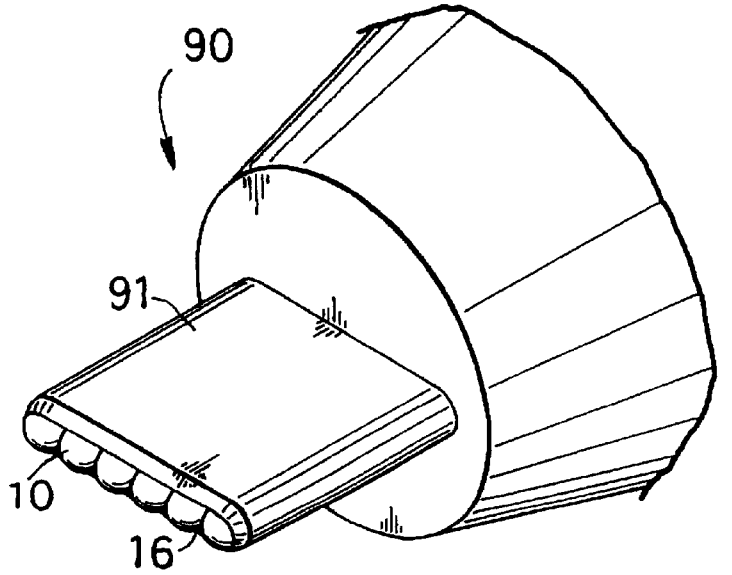
FIG. 21 is an enlarged perspective view of the distal end of an applicator that is provided in a still different embodiment.

FIG. 21 shows still another modification wherein the tip 90 has a body 91 that has been made of an elliptic pipe and consequently is of a straight shape without any stepped portion in its outer appearance.

Figure 22:
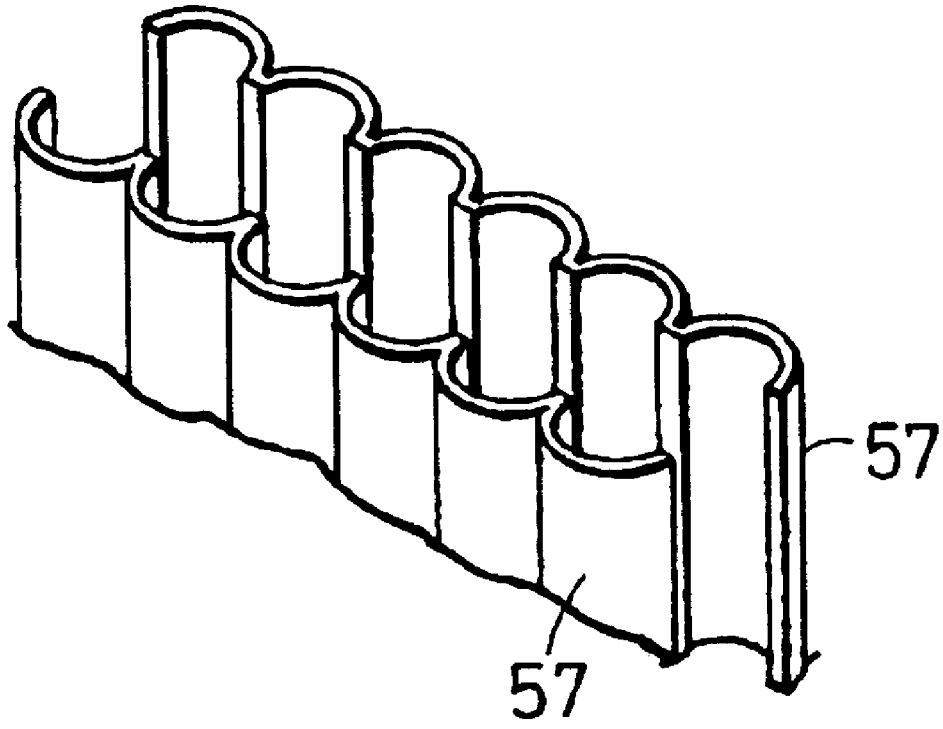
FIG. 22 illustrates one manner of manufacturing the penpoint tip of the invention.

FIG. 22 shows a further alternative possibility, in which split halves 57 are prepared by the machining, forging, pressing, injection-molding or otherwise and are subsequently bonded, fittingly united, electrically welded or brazed together to provide a penpoint tip. The other penpoint tips shown in FIGS. 9 and 10 may also be constructed using similar halves.

Figure 25:
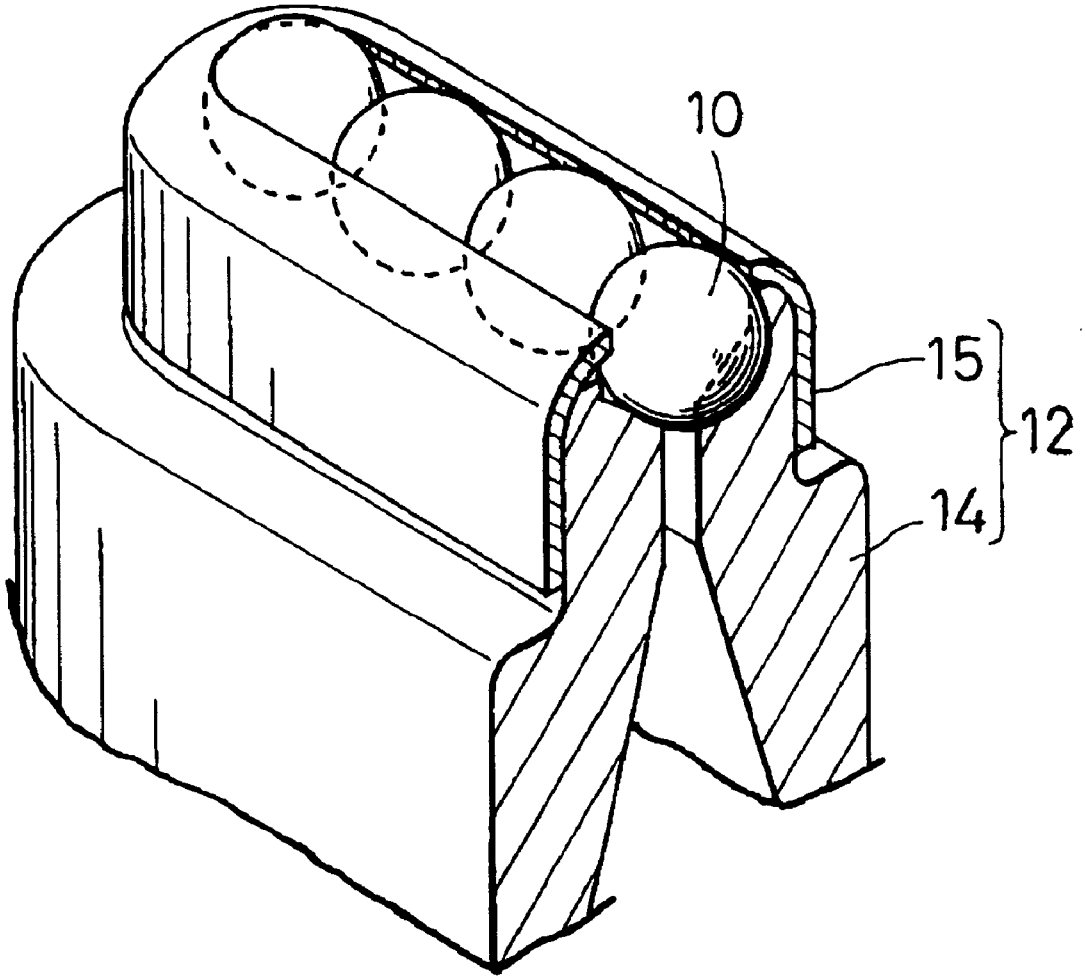
FIG. 25 is a similar fragmentary perspective view of the penpoint tip provided in a yet still further embodiment and shown partly in cross section.
Figure 26:
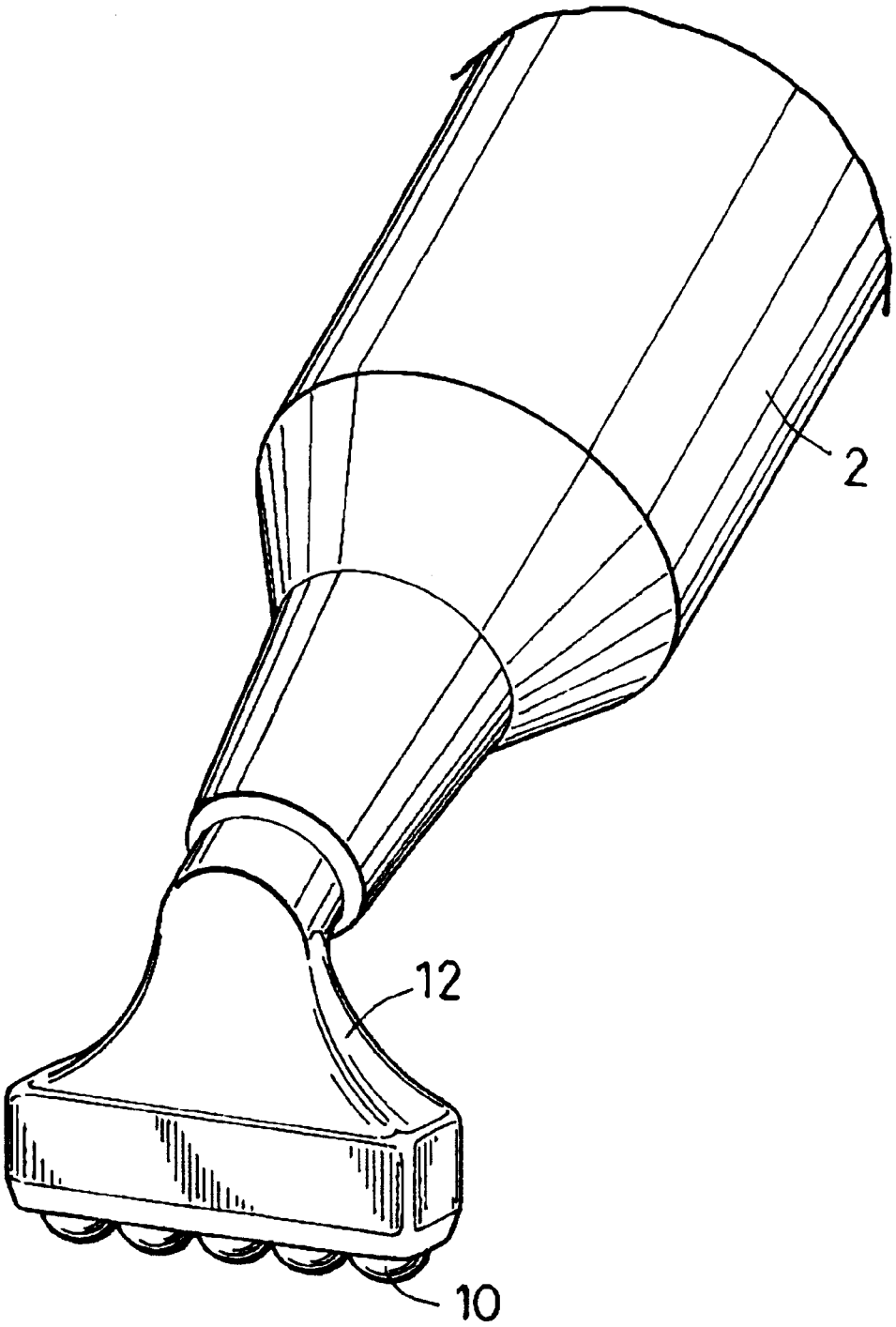
FIGS. 26 and 27 are enlarged perspective views of distal ends of the applicators that are provided in other embodiments.
Figure 27:
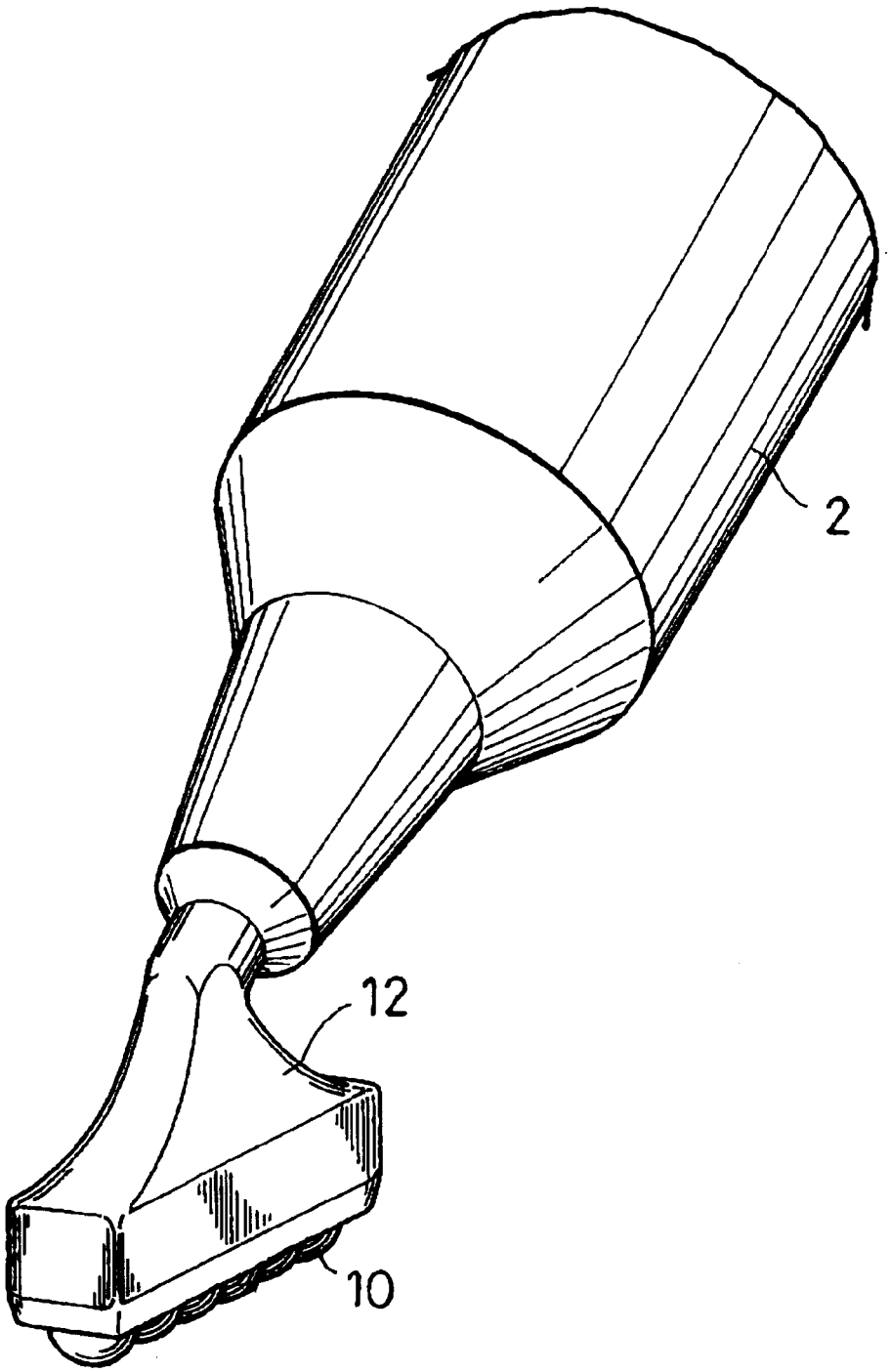
Figure 28:
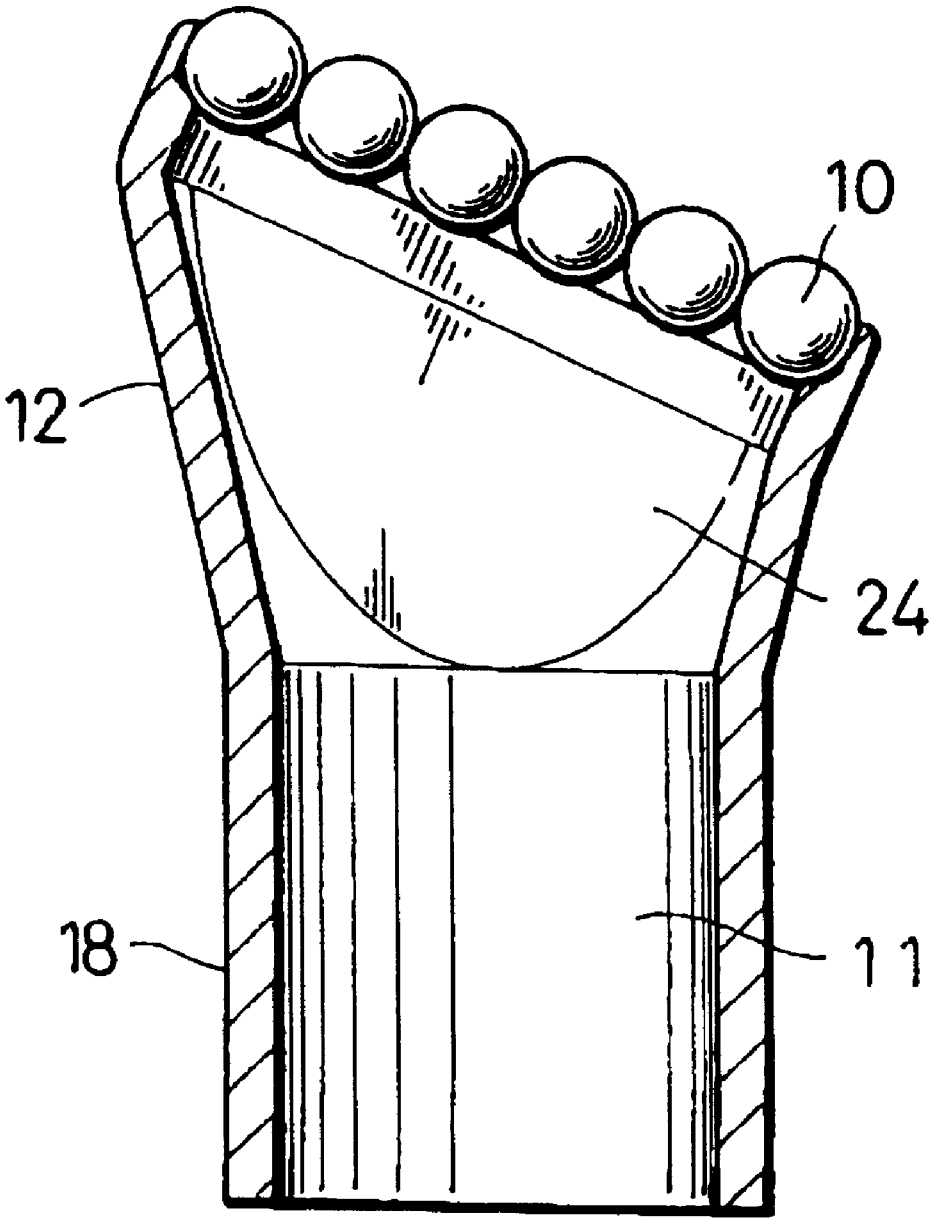
FIGS. 28 and 29 are cross-sectional front elevations of the penpoint tips provided in still different embodiments of the present invention.
Figure 29:
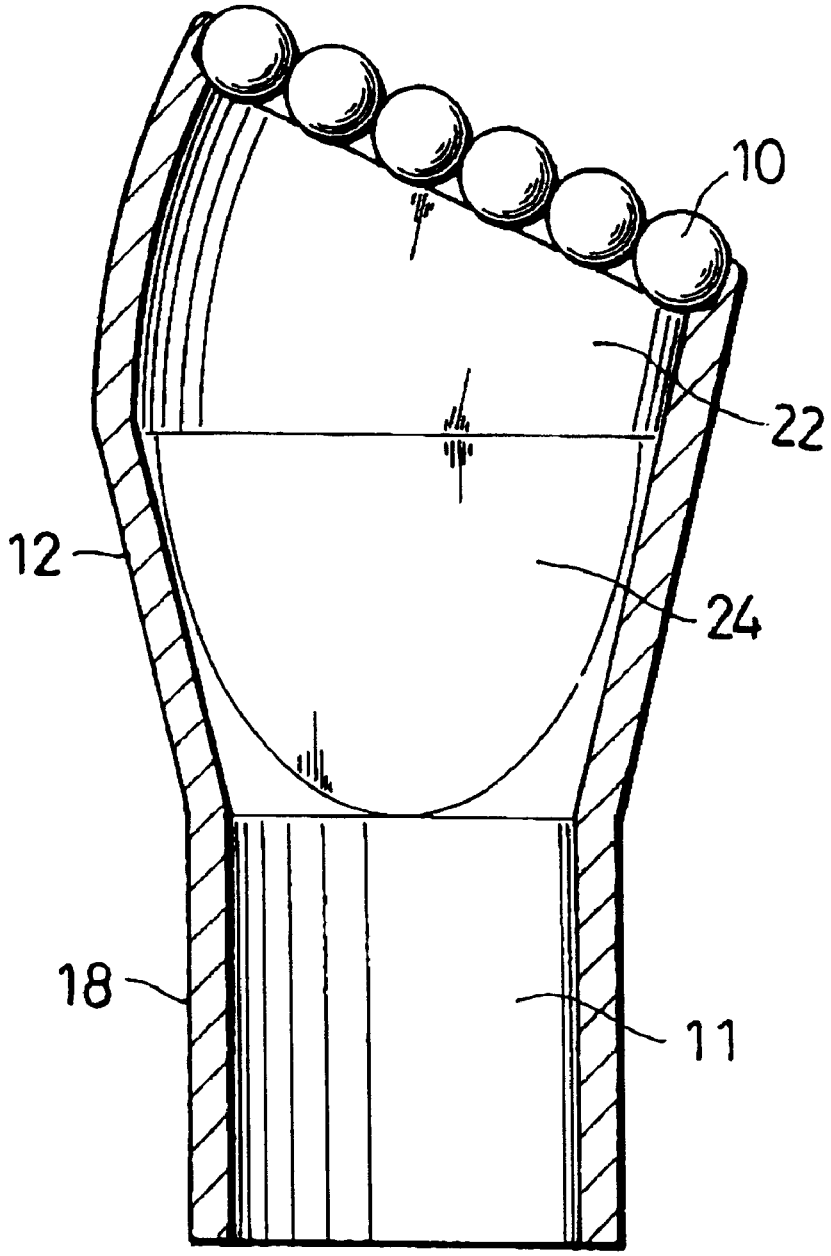

The tip body 12 can consist of some constituent members 14 and 15 as shown in FIG. 25. In this case, the balls 10 will be placed at first on the first member 14 and then the second one 15 will be fitted thereon to provide the tip body 12. Those first and second members may be made of different materials. In one example, the first member 14 is made of a plastics, with the second member 15 being made of a metal such as steel. These members are easy to manufacture. The plastics member 14 will reduce frictional resistance imparted to the balls 10, thereby affording smoother ink application and diminishing abrasion of the balls during ink application. The balls will thus be protected from early slipping-off. Contrarily, the first member 14 may be made of a metal, with the second one 15 made of a plastics.

The penpoint tip or ink applicator of the present invention may further be modified in the following manner.

Namely, the tip body 12 may be curved, or its distal end may be slanted in a fashion as shown in FIG. 26, 27, 28 or 29. In one example of FIG. 26, the tip body 12 is curved relative to the cylindrical shaft 2 in a direction of the minor axis of the opening. In a further example of FIG. 27, said body 12 is curved similarly but in another direction of the major axis of said opening. In a still further modification shown in FIG. 28, the distal end portion of the tip body 12 is cut somewhat shorter and slanted, whereas in a yet still further modification shown in FIG. 29 said distal end is prolonged and slanted. These examples will optimize the angle between the cylindrical shaft 2 and a surface such as a paper sheet to be linked, so as to afford easier and more efficient application of ink, consequently diminishing fatigue for users who work for many hours with such an applicator.

In summary, a plurality of the balls arranged in the present penpoint tip makes is possible to draw a thick line with one stroke of the penpoint tip. All the balls will spin about their individual centers independently of each other. They rotate at different rotational speeds corresponding to different linear speeds at which the penpoint's portions move on and along a paper sheet or the like. Harmonized amounts of an ink will thus be applied to the sheet's zones in such a fashion that any desired curved line can be drawn with one stroke, whether or not its thickness or width varies along the course of stroke.

The present applicator having such a penpoint tip incorporated therein and comprising a plurality of balls is therefore useful in writing thick line, whether straight or curved and whether or not of a varying width.

What is claimed is:

1. A penpoint tip comprising: a tip body, at least three balls, the tip body consisting of a ball retainer with an opening and an ink-feeding rigid tube formed integral with the ball retainer and having an ink feed bore in fluid communication therewith, wherein the balls are held in a row within the ball retainer of the tip body such that a part of each ball is exposed outwards from the opening, the ball retainer having an exposed peripheral wall extending around the opening with the exposed peripheral wall being deformed towards the balls and partially around each ball so as to confine movement of the balls in their row.

2. A penpoint tip as defined in claim 1, wherein each ball held in the ball retainer is rotatable around its center.

3. A penpoint tip as defined in claim 1, wherein the opening of the tip body is of an elongated circular shape whose minor axis is smaller than the diameter of each ball so that the balls are held in the tip body and disengageable therefrom.

4. A penpoint tip as defined in claim 3, wherein the opening has a major axis not exceeding the product of the diameter and the number of the balls held in the retainer.

5. A penpoint tip as defined in claim 3, further comprising a ball seat extending along the row of the balls and disposed at an inner surface region of the ball retainer, the region juxtaposed to the ink-feeding tube so that the balls rest on the seat.

6. A penpoint tip as defined in claim 3, wherein the opening has an outer edge caulkingly drawn towards the balls and partially around each ball.

7. A penpoint tip as defined in claim 3, wherein the opening has an outer end portion that is corrugated.

8. A penpoint tip as defined in claim 3, wherein the opening has an outer edge caulkingly drawn towards the balls and partially around each ball, and the opening has an outer end portion that is corrugated.

9. A penpoint tip as defined in claim 1, further comprising a ball seat extending along the row of the balls and disposed at an inner surface region of the ball retainer, the region juxtaposed to the ink-feeding tube so that the balls rest on the seat.

10. A penpoint tip as defined in claim 9, wherein the seat is a tapered, inclined flat plane.

11. A penpoint tip as defined in claim 9, wherein the seat has spherical recesses formed therein.

12. A penpoint tip as defined in claim 9, wherein the seat has groove-shaped cutouts corresponding to centers of the respective balls, so that edges of each cutout contact each ball and a bottom of each cutout is separated from each ball.

13. A penpoint tip as defined in claim 9, further comprising grooves formed in the seat so as to communicate with the ink-feeding tube.

14. An applicator comprising a shaft with a penpoint tip thereon and an ink reservoir, the shaft being graspable by a hand of a user to facilitate manipulation of the applicator, the penpoint tip is secured to a distal end of the reservoir and comprising a tip body, a plurality of balls, the tip body consisting of a ball retainer with an opening and an ink-feeding rigid tube formed integral with the ball retainer and having an ink feed bore in fluid communication therewith, wherein the balls are held in a row within the ball retainer of the tip body such that a part of each ball is exposed outwards from the opening, and a valve element which is movable against a valve seat to block flow of ink from the ball retainer into the reservoir, the ball retainer having exposed peripheral wall extending around the opening, the exposed peripheral wall be deformed towards the balls and partially around each ball so as to confine movement of the balls in their row.

15. An applicator as defined in claim 14, wherein the opening of the tip body is of an elongated circular shape whose minor axis is smaller than the diameter of each ball so that the balls are held in the tip body and disengageable therefrom.

16. An applicator as defined in claim 15, wherein the opening has an outer edge caulkingly drawn towards the balls and partially around each ball.

17. An applicator as defined in claim 15, wherein the opening has an outer end portion that is corrugated.

18. An applicator as defined in claim 14, further comprising a ball seat extending along the row of the balls and disposed at an inner surface region of the ball retainer, the region juxtaposed to the ink-feeding tube so that the balls rest on the seat.

19. An applicator as defined in claim 18, wherein the seat is a tapered, inclined flat plane.

20. An applicator as defined in claim 18, further comprising grooves formed in the seat so as to communicate with the ink-feeding tube.

21. An applicator as defined in claim 14, further comprising a cylindrical shaft with an axis, wherein a distal end portion of the penpoint tip is slanted relative to the cylindrical shaft so that a line through the center of the balls is non-orthogonal to the cylindrical shaft axis.

22. A penpoint tip comprising: a tip body, a plurality of balls, the tip body consisting of a ball retainer with an opening and an ink-feeding rigid tube formed integral with the ball retainer and having an ink feed bore in fluid communication therewith, wherein the balls are held in a row within the ball retainer of the tip body such that a part of each ball is exposed outwards from the opening, there being a single piece that defines at least a part of the ball retainer in contact with the balls and directly bounds at least a part of the ink feed bore, the ball retainer having an exposed peripheral wall extending around the opening, the exposed peripheral wall being deformed towards the balls and partially around each ball so as to confine movement of th balls in their row.

23. The penpoint tip as defined in claim 22 wherein the single piece is exposed at the outside of the penpoint tip.

24. In combination:

(a) a penpoint tip comprising: a tip body, a plurality of balls, the tip body consisting of a ball retainer with an opening and an ink-feeding rigid tube formed integral with the ball retainer and having an ink feed bore in fluid communication therewith, wherein the balls are held in a row within the ball retainer of the tip body such that a part of each ball is exposed outwards from the opening, there being no part of the penpoint tip that projects from the opening between adjacent balls; and (b) a supply of ink within the ink feed bore and having a viscosity in the range of 5–30,000 mPa·S, the ball retainer having an exposed peripheral wall extending around the opening, the exposed peripheral wall being deformed towards the balls and partially around each ball so as to confine movement of the balls in their row.

25. The combination according to claim 24 wherein the penpoint tip comprises at least three balls.

26. An applicator comprising a penpoint tip and an ink reservoir, the penpoint tip is secured to a distal end of the reservoir and comprising a tip body, a plurality of balls, the tip body consisting of a ball retainer with an opening and an ink-feeding rigid tube formed integral with the ball retainer and having an ink feed bore in fluid communication therewith, wherein the balls are held in a substantially straight row within the ball retainer of the tip body between substantially straight surfaces such that a part of each ball is exposed outwards from the opening, wherein one of the straight surfaces defines a corner and the tip body comprises a discrete cutout in the corner for receiving and stabilizing one of the balls, the ball retainer having an exposed peripheral wall extending around the opening, the peripheral wall being deformed towards the balls and partially around each ball so as to confine movement of the balls in their row. .

* * * * *